US008204400B2

(12) United States Patent
Karasawa et al.

(10) Patent No.: US 8,204,400 B2
(45) Date of Patent: Jun. 19, 2012

(54) CHARGING DEVICE CAPABLE OF EFFICIENTLY CHARGING IMAGE CARRIER

(75) Inventors: Shinya Karasawa, Kawasaki (JP); Takatsugu Fujishiro, Tokyo (JP); Takaaki Tawada, Yokohama (JP); Hiromichi Ninomiya, Yokohama (JP); Takeshi Tabuchi, Sagamihara (JP); Naohiro Kumagai, Machida (JP); Akira Fujimori, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 577 days.

(21) Appl. No.: 12/352,117

(22) Filed: Jan. 12, 2009

(65) Prior Publication Data

US 2009/0180795 A1 Jul. 16, 2009

(30) Foreign Application Priority Data

Jan. 15, 2008 (JP) ..... 2008-006182

(51) Int. Cl.
*G03G 15/02* (2006.01)

(52) U.S. Cl. ..... 399/100; 399/115; 399/123; 399/168

(58) Field of Classification Search ..... 399/91, 399/98, 99, 100, 110, 115, 168, 123
See application file for complete search history.

(56) References Cited

U.S. PATENT DOCUMENTS

| | | | |
|---|---|---|---|
| 5,557,373 | A | 9/1996 | Miyashita et al. |
| 6,546,219 | B2 | 4/2003 | Sato et al. |
| 6,778,797 | B2 | 8/2004 | Sato et al. |
| 6,977,022 | B2 | 12/2005 | Sato et al. |
| 7,062,194 | B2 | 6/2006 | Yanagida et al. |
| 7,139,504 | B2 | 11/2006 | Yanagida et al. |
| 7,218,877 | B2 | 5/2007 | Yanagida et al. |
| 7,266,324 | B2 | 9/2007 | Yanagida et al. |
| 7,391,991 | B2 | 6/2008 | Suda et al. |
| 7,463,845 | B2 | 12/2008 | Suda et al. |
| 2005/0191081 | A1 | 9/2005 | Muraishi et al. |

(Continued)

FOREIGN PATENT DOCUMENTS

| | | | |
|---|---|---|---|
| CN | 1755535 | A | 4/2006 |

(Continued)

OTHER PUBLICATIONS

Office Action issued Sep. 13, 2010, in China Patent Application No. 200910002253.1.

Chinese Office Action mailed on Mar. 26, 2012, issued for Chinese Patent Application No. 200910002253.1 (with partial English translation).

*Primary Examiner* — David Porta
*Assistant Examiner* — Jessica L Eley
(74) *Attorney, Agent, or Firm* — Oblon, Spivak, McClelland, Maier & Neustadt, L.L.P.

(57) ABSTRACT

A charging device includes a charging roller, a drive transmission device, and a charging roller cleaner. The charging roller opposes an image carrier driven to rotate and rotates to charge the image carrier. The charging roller cleaner contacts the charging roller to clean the charging roller. The drive transmission device transmits torque from the image carrier to the charging roller, and includes an image carrier gear and a driven gear. The image carrier gear and the driven gear form a gear train to drive the charging roller in response to rotation of the image carrier. The charging roller cleaner is disposed facing a rear surface of the charging roller to prevent displacement of the charging roller due to a force generated by a pressure angle formed between the image carrier gear and the driven gear when the charging roller rotates in response to rotation of the image carrier.

18 Claims, 18 Drawing Sheets

U.S. PATENT DOCUMENTS

| | | | | |
|---|---|---|---|---|
| 2005/0271420 | A1 | 12/2005 | Arai et al. | |
| 2006/0067727 | A1* | 3/2006 | Suda et al. | 399/100 |
| 2006/0099005 | A1* | 5/2006 | Kitazawa et al. | 399/100 |
| 2006/0115286 | A1 | 6/2006 | Uchitani et al. | |
| 2006/0222399 | A1* | 10/2006 | Thompson | 399/100 |
| 2007/0196123 | A1 | 8/2007 | Mizuishi et al. | |

FOREIGN PATENT DOCUMENTS

| | | |
|---|---|---|
| JP | 3073102 | 6/2000 |
| JP | 2004-361916 | 12/2004 |
| JP | 2006-98476 | 4/2006 |
| JP | 2007-155797 | 6/2007 |

* cited by examiner

CHARGING DEVICE CAPABLE OF EFFICIENTLY CHARGING IMAGE CARRIER

CROSS-REFERENCE TO RELATED APPLICATIONS

The present application is based on and claims priority from Japanese Patent Application No. 2008-006182, filed on Jan. 15, 2008 in the Japan Patent Office, the entire contents of which are hereby incorporated herein by reference.

BACKGROUND OF THE INVENTION

1. Field of the Invention

Exemplary aspects of the present invention relate to a charging device, and more particularly, to a charging device for efficiently charging an image carrier.

2. Description of the Related Art

Related-art image forming apparatuses, such as copiers, facsimile machines, printers, and multifunction devices having at least one of copying, printing, scanning, and facsimile functions, typically form an image on a recording medium (e.g., a sheet) based on image data using an electrophotographic method.

For example, a charging device charges a surface of a photoconductor serving as an image carrier. An optical writer emits a light beam onto the charged surface of the photoconductor to form an electrostatic latent image on the photoconductor according to the image data. A development device develops the electrostatic latent image with a developer (e.g., toner) to form a toner image on the photoconductor. A primary transfer roller transfers the toner image formed on the photoconductor onto an intermediate transfer belt. After a secondary transfer roller transfers the toner image carried by the intermediate transfer belt onto the recording medium, the toner image is fixed on the recording medium by heat and pressure applied by a fixing device. Thus, the toner image is formed on the recording medium.

One example of related-art charging devices using a non-contact type charging method includes a charging roller. The charging roller is driven to rotate by a gear and motor assembly, and charges a photoconductor without directly contacting the photoconductor. The charging roller maintains a predetermined distance from the photoconductor, forming a charging gap therebetween.

In order to provide high-quality imaging, the charging gap needs to be kept constant with extremely great precision. However, the charging roller is susceptible to a force generated by the pressure angle of the gears which causes the charging roller to move away from the photoconductor, in turn causing uneven, insufficient charging of the photoconductor.

Accordingly, there is a need for a technology capable of preventing the charging roller from moving away from the photoconductor as described above in order to prevent such uneven, insufficient charging of the photoconductor.

BRIEF SUMMARY OF THE INVENTION

This specification describes a charging device according to illustrative embodiments of the present invention. In one illustrative embodiment of the present invention, the charging device includes a charging roller, a drive transmission device, and a charging roller cleaner. The charging roller is configured to oppose an image carrier driven to rotate and rotates to charge the image carrier. The charging roller cleaner is configured to contact the charging roller to clean the charging roller. The drive transmission device is configured to transmit torque from the image carrier to the charging roller, and includes an image carrier gear supported by the image carrier and a driven gear supported by the charging roller. The image carrier gear and the driven gear form a gear train to drive the charging roller in response to rotation of the image carrier. The charging roller cleaner is disposed facing a rear surface of the charging roller to prevent displacement of the charging roller due to a force generated by a pressure angle formed between the image carrier gear and the driven gear as the image carrier gear and the driven gear mesh when the charging roller rotates in response to rotation of the image carrier.

In a further illustrative embodiment of the present invention, the charging device includes a charging roller, a drive transmission device, and a charging roller cleaner. The charging roller is configured to oppose an image carrier driven to rotate and rotates to charge the image carrier. The drive transmission device is configured to transmit torque from the image carrier to the charging roller, and includes a gear train configured to generate the torque to drive the charging roller. The charging roller cleaner is configured to contact the charging roller to clean the charging roller. The charging roller cleaner is disposed facing a rear surface of the charging roller to receive the torque generated by the gear train.

BRIEF DESCRIPTION OF THE DRAWINGS

A more complete appreciation of the invention and the many attendant advantages thereof will be more readily obtained as the same becomes better understood by reference to the following detailed description when considered in connection with the accompanying drawings, wherein.

DETAILED DESCRIPTION OF THE INVENTION

Figure 1:
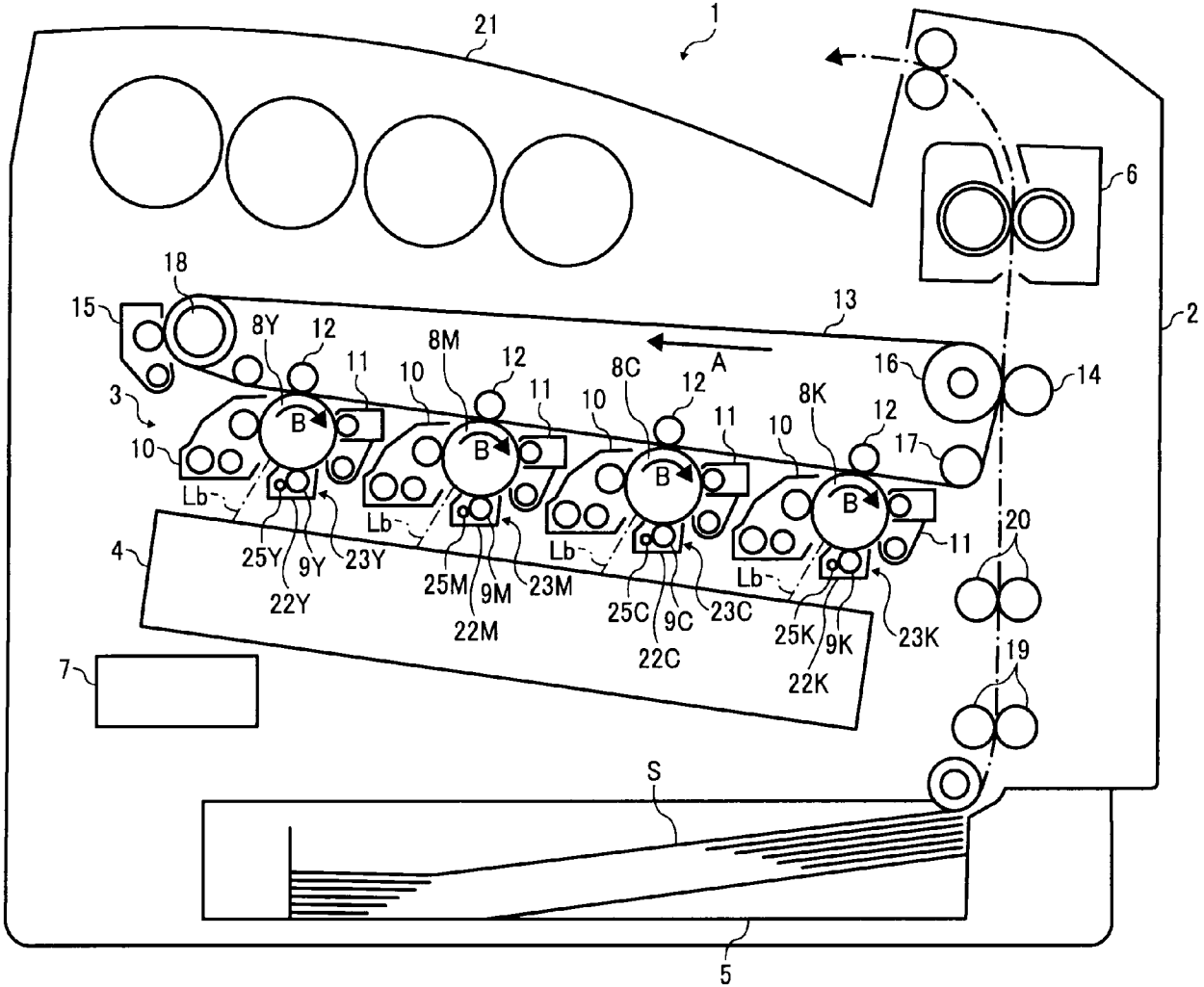
FIG. 1 is a schematic view of an image forming apparatus according to an illustrative embodiment of the present invention.

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an illustrative embodiment of the present invention is described.

FIG. 1 is a schematic view of the image forming apparatus 1, for example, a color printer. The image forming apparatus 1 includes a body 2 and an output tray 21. The body 2 includes a printer engine 3, an optical writer 4, a paper tray 5, a fixing device 6, a waste toner collection container 7, conveyance rollers 19, and a pair of registration roller 20. The printer engine 3 includes process cartridges 23Y, 23M, 23C, and 23K, development devices 10, cleaning devices 11, primary transfer rollers 12, an intermediate transfer belt 13, a secondary transfer roller 14, a cleaning device 15, a driving roller 16, an entrance roller 17, and a tension roller 18. The process cartridges 23Y, 23M, 23C, and 23K include photoconductors 8Y, 8M, 8C, and 8K and charging devices 22Y, 22M, 22C, and 22K, respectively. The charging devices 22Y, 22M, 22C, and 22K include charging rollers 9Y, 9M, 9C, and 9K, and charging roller cleaners 25Y, 25M, 25C, and 25K, respectively.

The image forming apparatus 1 may be a copier, a facsimile machine, a printer, a plotter, a multifunction printer having at least one of copying, printing, scanning, plotter, and facsimile functions, or the like. According to this illustrative embodiment, the image forming apparatus 1 forms a full color toner image by superimposing yellow, magenta, cyan, and black toner images on each other on the intermediate transfer belt 13. However, it is to be noted that the image forming apparatus 1 is not limited to the full color image forming apparatus and may form a color and/or monochrome image with other structure.

The printer engine 3 forms yellow, magenta, cyan, and black toner images and transfers the toner images onto a recording sheet S serving as a recording medium or a transfer medium. The photoconductors 8Y, 8M, 8C, and 8K, serving as image carriers, have a drum-like shape and carry the yellow, magenta, cyan, and black toner images, respectively. The charging devices 22Y, 22M, 22C, and 22K, the development devices 10, the cleaning devices 11, and the primary transfer rollers 12 are provided around the photoconductors 8Y, 8M, 8C, and 8K, respectively.

Figure 2:
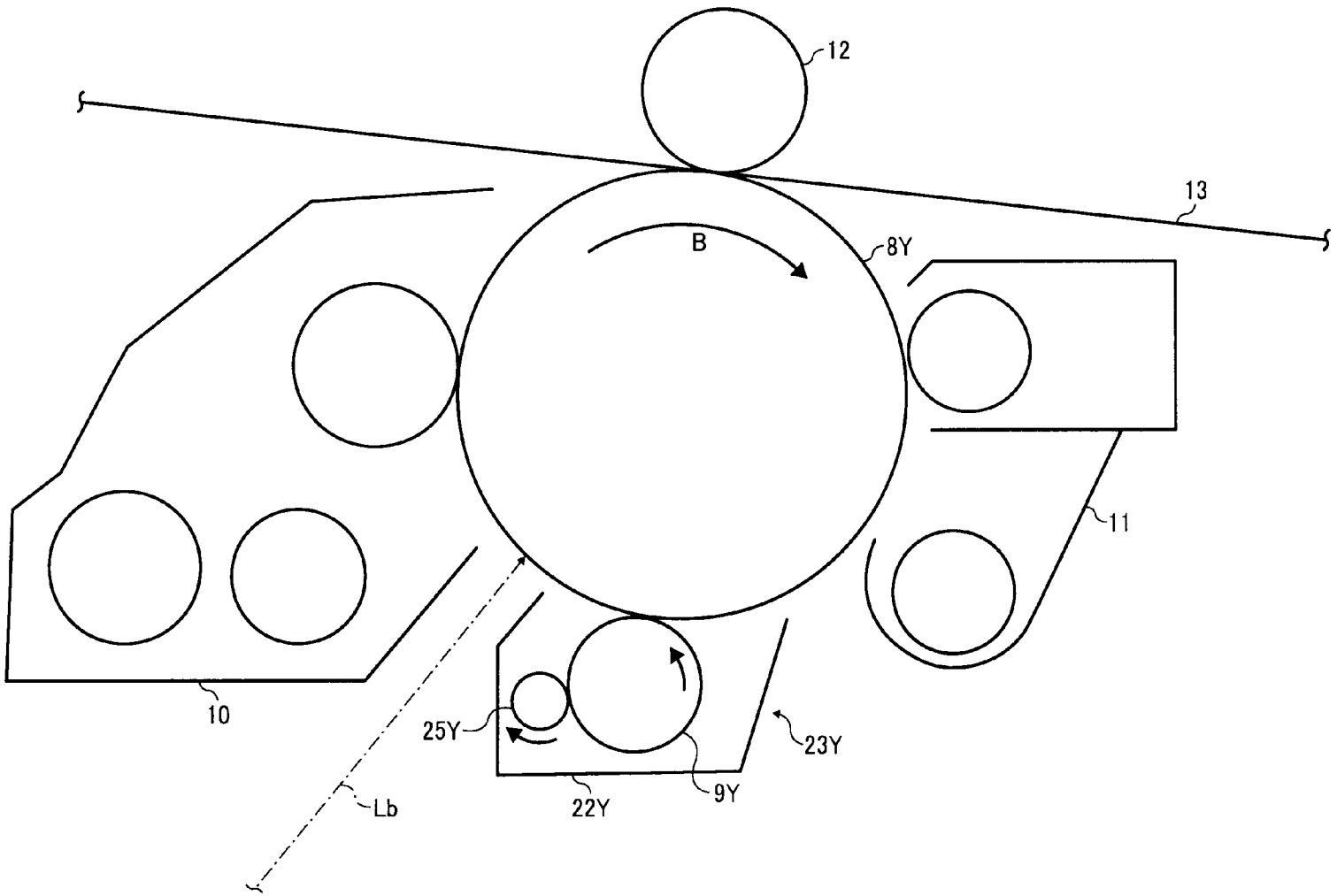
FIG. 2 is a schematic view of a photoconductor, a charging device, a development device, a cleaning device, and a primary transfer roller included in the image forming apparatus shown in FIG. 1.

FIG. 2 is a schematic view of the photoconductor 8Y, the charging device 22Y, the development device 10, the cleaning device 11, and the primary transfer roller 12.

It is to be noted that the respective photoconductors 8Y, 8M, 8C, and 8K and the charging devices 22Y, 22M, 22C, and 22K depicted in FIG. 1 correspond to yellow, magenta, cyan, and black toner, respectively, and have a common structure. Therefore, redundant descriptions thereof are omitted here.

The photoconductor 8Y has a cylindrical shape and driven to rotate in a direction B around a central axis thereof by driving force of a driving motor connected thereto. A photoconductor layer, in which an electrostatic latent image is formed, is provided on an outer circumferential surface of the photoconductor 8Y.

The charging roller 9Y contacts the outer circumferential surface of the photoconductor 8Y or remains slightly separated from the outer circumferential surface of the photoconductor 8Y. When a power supply member supplies voltage to the charging roller 9Y, corona discharge occurs between the charging roller 9Y and the photoconductor 8Y, thereby uniformly charging the outer circumferential surface of the photoconductor 8Y.

When the optical writer 4 depicted in FIG. 1 emits a laser beam Lb based on image data to expose the uniformly charged surface of the photoconductor 8Y, as illustrated in FIG. 2, an electrostatic latent image is formed on the outer circumferential surface of the photoconductor 8Y based on the image data.

When the development device 10 supplies toner to the photoconductor 8Y, the supplied toner adheres to the electrostatic latent image formed on the surface of the photoconductor 8Y, so that the electrostatic latent image is made visible as a toner image.

The intermediate transfer belt 13 includes a resin film or a rubber as a base substance, and is wrapped around the driving roller 16, the entrance roller 17, and the tension roller 18, as illustrated in FIG. 1. When the driving roller 16 is driven to rotate by a driving motor connected to the driving roller 16, the intermediate transfer belt 13 rotates in a direction A, as illustrated in FIG. 1. With rotation of the intermediate transfer belt 13, the entrance roller 17 rotates due to frictional force between the entrance roller 17 and the intermediate transfer belt 13, as does the tension roller 18.

The primary transfer rollers 12 are provided on an inner circumferential surface (an inner side) of the intermediate transfer belt 13, respectively. When the primary transfer rollers 12 are supplied with a transfer voltage, yellow, magenta, cyan, and black toner images formed on the photoconductors 8Y, 8M, 8C, and 8K are transferred and superimposed onto the intermediate transfer belt 13, thereby forming a full color toner image on the intermediate transfer belt 13.

After the toner image formed on the photoconductor 8Y is transferred to the intermediate transfer belt 13, the cleaning device 11 cleans the outer circumferential surface of the photoconductor 8Y to remove residual toner, paper powder, and the like, remaining on the outer circumferential surface of the photoconductor 8Y.

The paper tray 5 depicted in FIG. 1 stores a recording sheet S. After being fed from the paper tray 5, the recording sheet S is conveyed to a transfer position, at which the intermediate transfer belt 13 contacts the secondary transfer roller 14, via the conveyance rollers 19 and the registration roller pairs 20. When the recording sheet S reaches the transfer position, the secondary transfer roller 14 is supplied with a transfer voltage to transfer the full color toner image formed on the intermediate transfer belt 13 onto the recording sheet S. Thereafter, the recording sheet S bearing the full color toner image is conveyed to the fixing device 6.

In a fixing process, the fixing device 6 supplies the recording sheet S with heat and pressure, thereby melting the toner image to be fixed on the recording sheet S. The recording sheet S is then discharged to the output tray 21 provided on a top surface of the body 2 of the image forming apparatus 1 depicted in FIG. 1.

After the full color toner image formed on the intermediate transfer belt 13 is transferred onto the recording sheet S, the cleaning device 15 cleans an outer circumferential surface of the intermediate transfer belt 13 to remove residual toner, paper powder, and the like, remaining on the outer circumferential surface of the intermediate transfer belt 13.

The waste toner collection container 7 depicted in FIG. 1 collects such waste toner removed by the cleaning device 15. The waste toner collection container 7 is detachably attachable to the body 2. When the waste toner collection container 7 is almost filled with waste toner, the waste toner collection container 7 is detached from the body 2. After removing the waste toner, the waste toner collection container 7 is again attached to the body 2.

According to this illustrative embodiment, the photoconductors 8Y, 8M, 8C, and 8K, and the charging devices 22Y, 22M, 22C, and 22K provided around the photoconductors 8Y, 8M, 8C, and 8K, which form the printer engine 3, are combined with the process cartridges 23Y, 23M, 23C, and 23K, respectively. The process cartridges 23Y, 23M, 23C, and 23K are detachably attachable to the body 2. Alternatively, the charging devices 22Y, 22M, 22C, and 22K may be independently provided in the body 2 without being combined with the process cartridges 23Y, 23M, 23C, and 23K.

Provision of the process cartridges 23Y, 23M, 23C, and 23K combining the photoconductors 8Y, 8M, 8C, and 8K, and the charging devices 22Y, 22M, 22C, and 22K, respectively, facilitates replacement and maintenance of the process cartridges 23Y, 23M, 23C, and 23K and maintains positional accuracy between the photoconductors 8Y, 8M, 8C, and 8K, and the charging devices 22Y, 22M, 22C, and 22K, thereby improving image quality.

According to this illustrative embodiment, the photoconductors 8Y, 8M, 8C, and 8K, and the charging devices 22Y, 22M, 22C, and 22K are combined with the process cartridges 23Y, 23M, 23C, and 23K, respectively. Alternatively, however, the process cartridges 23Y, 23M, 23C, and 23K may include various configurations. For example, the process cartridges 23Y, 23M, 23C, and 23K may include either or both of the development device 10 and the cleaning device 11.

Figure 3:
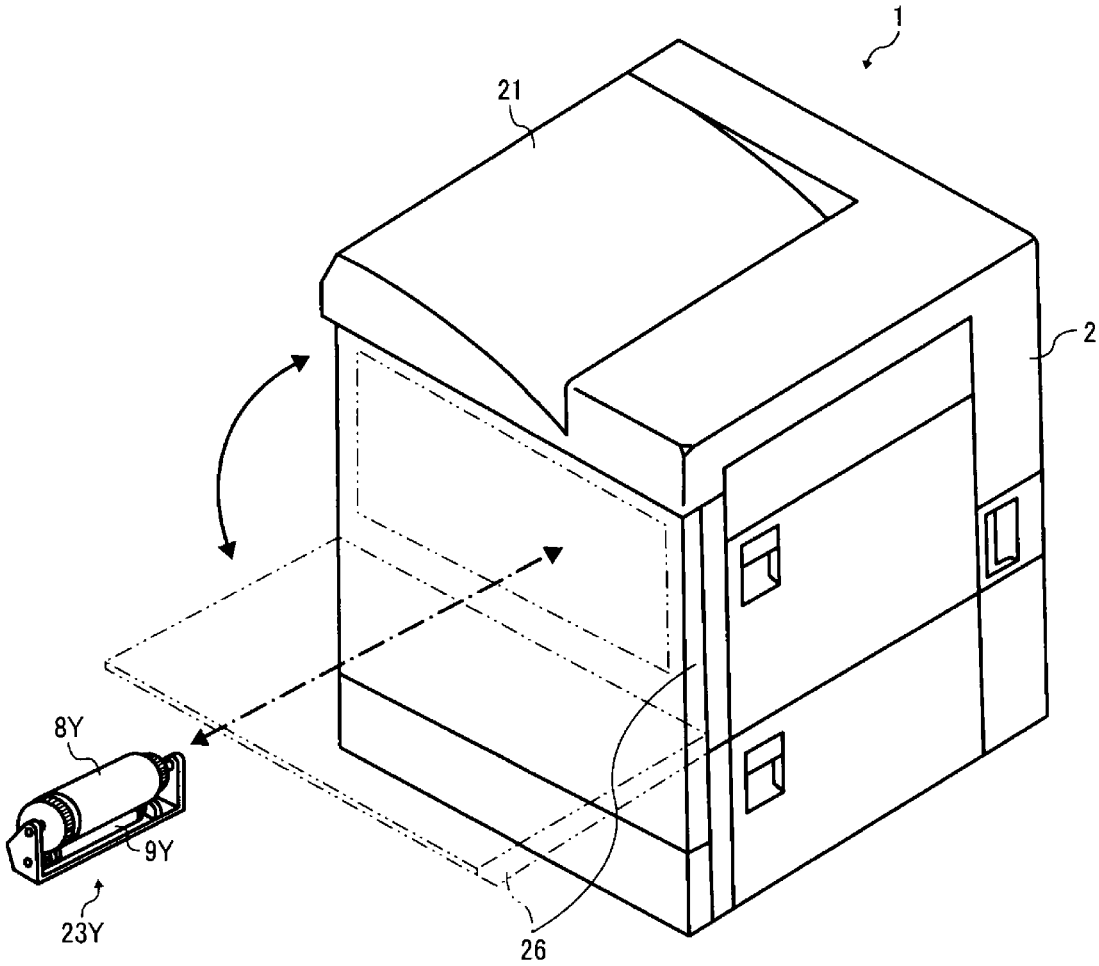
FIG. 3 is a perspective view of the image forming apparatus shown in FIG. 1.

FIG. 3 is a perspective view of the image forming apparatus 1. The body 2 further includes a side cover 26. By opening the side cover 26, a user can easily perform replacement, maintenance, and the like of the process cartridge 23Y, the intermediate transfer belt 13, and the waste toner collection container 7 depicted in FIG. 1. It is to be noted that the intermediate transfer roller 13, the driving roller 16, the entrance roller 17, the tension roller 18, and the cleaning device 15 depicted in FIG. 1 are stored in a belt case, not shown, as a single unit.

Figure 4:
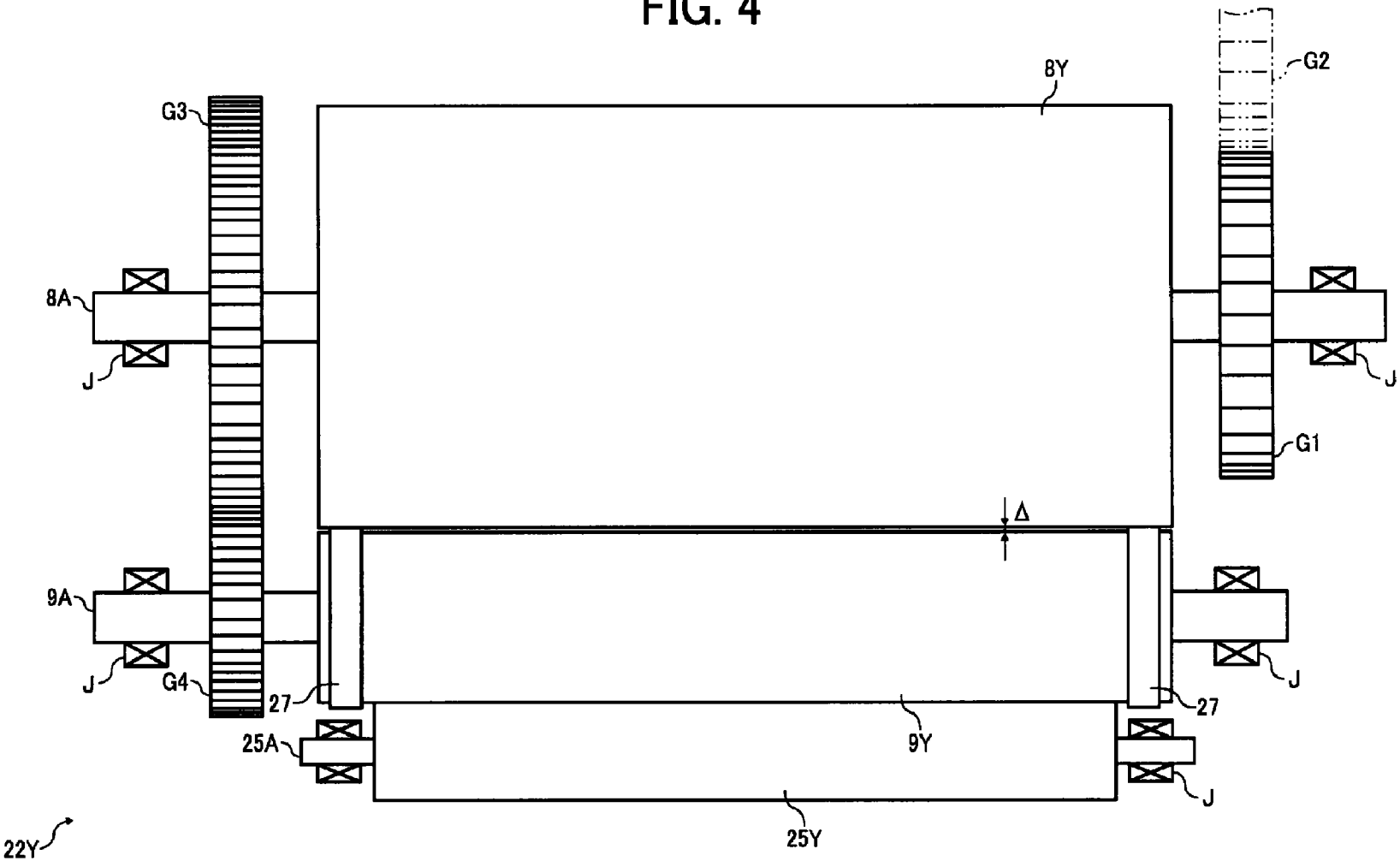
FIG. 4 is a top plan view of the photoconductor and the charging device shown in FIG. 2.

Referring to FIG. 4, a description is now given of a configuration of the charging devices 22Y, 22M, 22C, and 22K. FIG. 4 is a top plan view of the photoconductor 8Y and the charging device 22Y. The photoconductor 8Y includes a central shaft 8A. The charging roller 9Y includes a central shaft 9A and a spacer 27. The charging roller cleaner 25Y includes a central shaft 25A. The charging device 22Y further includes gears G1, G2, G3, and G4.

The gears G1, G2, G3, and G4, serving as a drive transmission assembly, include involute gears and transmit torque from the photoconductor 8Y to the charging roller 9Y.

The central shaft 8A is provided along the axial center of the photoconductor 8Y in the long direction thereof, and formed as a single piece with the photoconductor 8Y, and both ends of the central shaft 8A are supported by the body 2 or the process cartridge 23Y with bearings J. The gear G1 is fixed to one end of the central shaft 8A and engages the gear G2 connected to a motor. Therefore, as the motor drives the gear G2, the photoconductor 8Y is driven to rotate with the rotation of the gear G1. Alternatively, instead of providing the gears G1 and G2, the central shaft 8A of photoconductor 8Y may be directly connected to the motor.

The gear G3 is fixed to another end of the central shaft 8A. Since the gear G3 is held by the photoconductor 8Y via the central shaft 8A, the gear G3 is called a photoconductor gear (or an image carrier gear). The photoconductor gear G3 engages the driven gear G4 fixed to the central shaft 9A of the charging roller 9Y. The central shaft 9A of the charging roller 9Y is provided along the axial center of the charging roller 9Y in the long direction thereof, and formed as a single piece with the charging roller 9Y. Both ends of the central shaft 9A are supported by the body 2 or the process cartridge 23Y with bearings J.

The spacer 27 is circumferentially provided at both ends of the charging roller 9Y. The spacer 27 has an outer diameter that incorporates a gap Δ, such that the charging roller 9Y rotates to charge the photoconductor 8Y while separated from the photoconductor 8Y by a distance equal to the gap Δ.

The photoconductor gear G3 and the driven gear G4 form a gear train to drive the charging roller 9Y, associated with rotation of the photoconductor 8Y. Alternatively, the gear train, serving as a drive transmission device, may include an intermediate gear provided between the photoconductor gear G3 and the driven gear G4 to transmit torque from the photoconductor 8Y to the charging roller 9Y.

According to this illustrative embodiment, the charging roller 9Y does not contact the photoconductor 8Y. Alternatively, however, matters may be arranged so that the charging device 9Y contacts the photoconductor 8Y and still achieve the effect of the present invention.

A gear ratio between each gear is determined such that the spacer 27 does not slide over the photoconductor 8Y due to a circumferential velocity difference between the spacer 27 and the photoconductor 8Y, that is, the spacer 27 rotates at a circumferential velocity equal to that of the photoconductor 8Y. According to this illustrative embodiment, an outer diameter of the photoconductor 8Y equals a pitch circle diameter of the photoconductor gear G3, and an outer diameter of the spacer 27 equals a pitch circle diameter of the driven gear G4.

As illustrated in FIG. 4, the photoconductor gear G3 directly engages the driven gear G4, and the outer diameter of the photoconductor 8Y equals the pitch circle diameter of the photoconductor gear G3, and the outer diameter of the spacer 27 equals the pitch circle diameter of the driven gear G4. Alternatively, when the charging roller 9Y does not include the spacer 27, the outer diameter of the charging roller 9Y equals the pitch circle diameter of the driven gear G4.

The charging roller cleaner 25 contacts the charging roller 9Y to clean the charging roller 9Y. According to this illustrative embodiment, the charging roller cleaner 25 is roller-shaped. However, the charging device 22Y may include an irrotational charging roller cleaner 250 having a block-like shape, described below. In both cases, the charging roller cleaners 25 and 250 contact the charging roller 9Y to clean the charging roller 9Y and receive a load generated by a pressure angle of the gears generated as they mesh that is applied to the charging roller 9Y.

Figure 5:
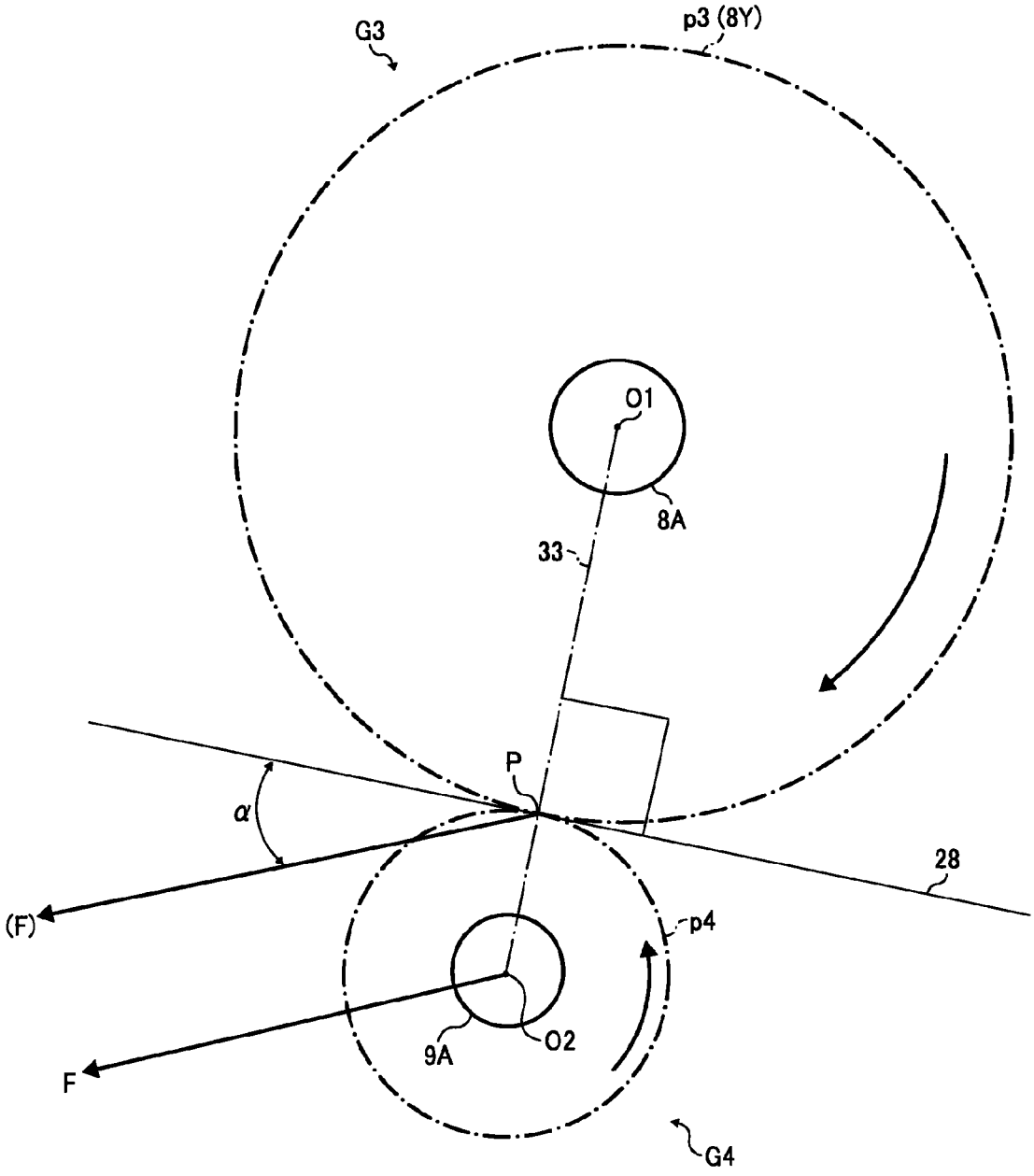
FIG. 5 is a schematic view of pitch circles of a photoconductor gear and a driven gear included in the charging device shown in FIG. 4.
Figure 6:
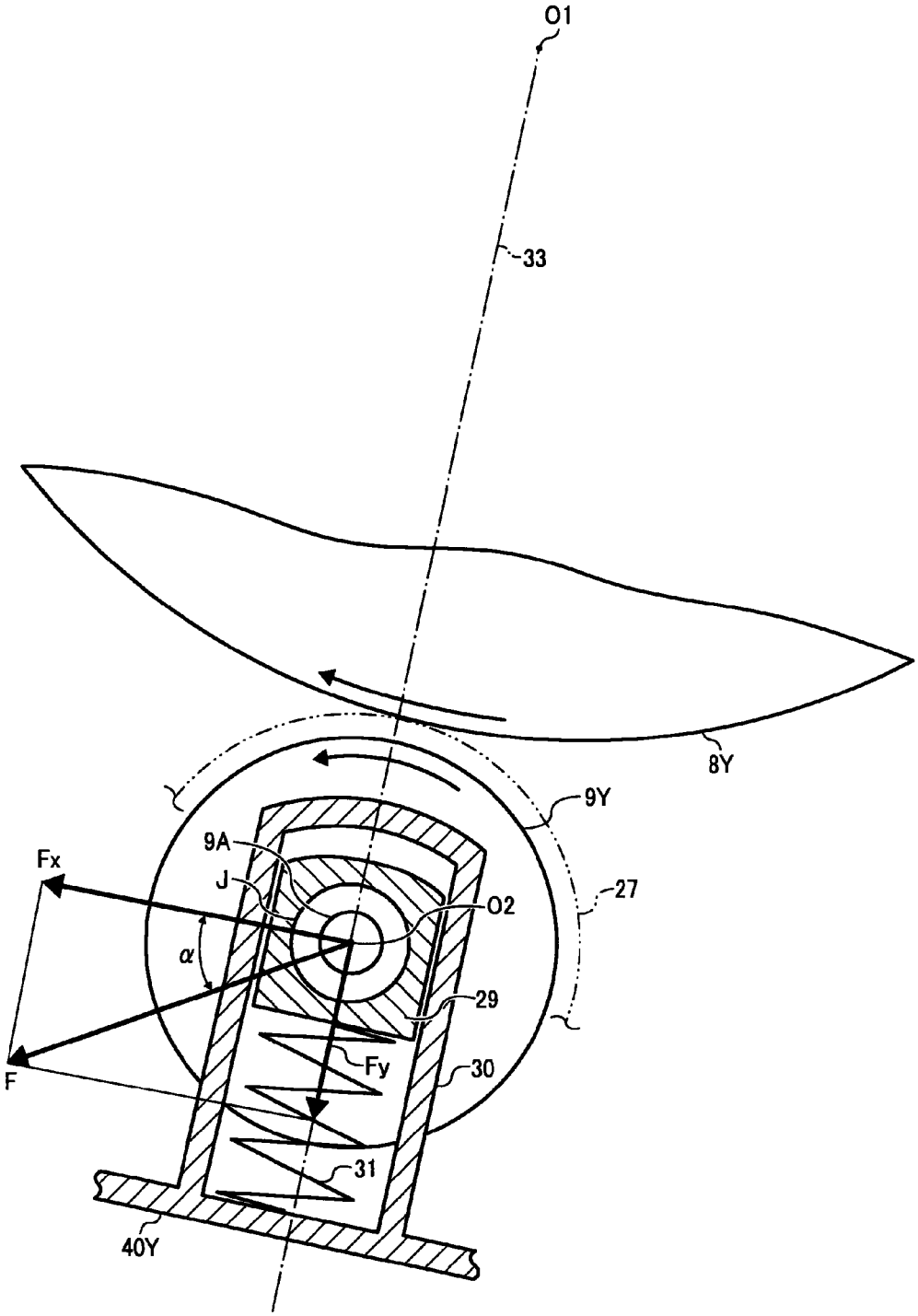
FIG. 6 is a schematic sectional view of the charging roller shown in FIG. 4.

Referring to FIGS. 5 and 6, a description is now given of displacement of the charging roller 9Y due to a force F generated by a pressure angle α. FIG. 5 is a schematic view of pitch circles of the photoconductor gear G3 and the driven gear G4. As the photoconductor gear G3 rotates clockwise, the driven gear G4 engaging the photoconductor gear G3 rotates counterclockwise. When a common contact point P between teeth of the photoconductor gear G3 and teeth of the driven gear G4 is provided on a line segment 33 connecting a center O1 of the photoconductor gear G3 with a center O2 of the driven gear G4, the common contact point P coincides with a common contact point between a pitch circle p3 of the photoconductor gear G3 and a pitch circle p4 of the driven gear G4. In addition, the line segment 33 and a common tangent line 28 of both the pitch circles p3 and p4 are perpendicular to each other at the common contact point P. A direction (F) passing through the common contact point P to form a pressure angle α with respect to the common tangent line 28 is equal to a direction of the force F generated by the pressure angle α when the driven gear G4 is driven by the photoconductor gear G3. The force F causes the driven gear G4 to rotate and acts on the central shaft 9A of the charging roller 9Y, thereby separating the charging roller 9Y from the photoconductor 8Y.

FIG. 6 is a schematic sectional view of the charging roller 9Y. The charging roller 9Y further includes a movable member 29, a guide member 30, and a biasing member 31.

A bearing J is attached to the movable member 29 to support the central shaft 9A. The movable member 29 is provided in the guide member 30 having a guiding surface parallel to the line segment 33 connecting the center O1 of the photoconductor gear G3 with the center O2 of the driven gear G4 (the central shaft 9A). The guide member 30 guides the movable member 29 in a direction in which the center O2 moves along the line segment 33.

The biasing member 31 here comprises an elastic spring, and is provided inside the guide member 30 to press the movable member 29 toward the center O1 of the photoconductor gear G3, so that the movable member 29 is movable along the guiding surface of the guide member 30. The spacer 27 contacts the photoconductor 8Y to prevent the biasing member 31 from moving the charging roller 9Y. The guide member 30 is provided in a frame 40Y forming the process cartridge 23Y or a frame forming the body 2 of the image forming apparatus 1.

When the photoconductor 8Y stops rotating, the charging roller 9Y contacts the photoconductor 8Y to prevent the biasing member 31 from moving the movable member 29. When the photoconductor 8Y rotates clockwise, the force F generated by the pressure angle α is transmitted from the central shaft 9A to the movable member 29.

The force F can be thought of as consisting of a force Fy component in a direction of movement of the movable member 29 and a force Fx component in a direction perpendicular to the line segment 33. Although the guide member 30 prevents the charging roller 9Y from moving in a direction of the force Fx component, the force Fy component acts on the charging roller 9Y to separate the charging roller 9Y from the photoconductor 8Y.

When the biasing member 31 has a greater force than the force Fy component, the charging roller 9Y does not separate from the photoconductor 8Y due to the force Fy component. However, as the force of the biasing member 31 increases, a drive load on the photoconductor 8Y or a load on the bearing J increases. In addition, when a rotational load on the charging roller 9Y increases, the charging roller 9Y tends to separate from the photoconductor 8Y by a distance greater than a predetermined distance. Therefore, especially in a non-contact charging method, the spacer 27 needs to precisely maintain a predetermined distance between the charging roller 8Y and the photoconductor 9Y, so as not to permit the charging roller 9Y to become separated from the photoconductor 8Y by greater than a predetermined distance. This is accomplished by arranging the charging roller cleaner in a specific way, as is described below.

Figure 7:
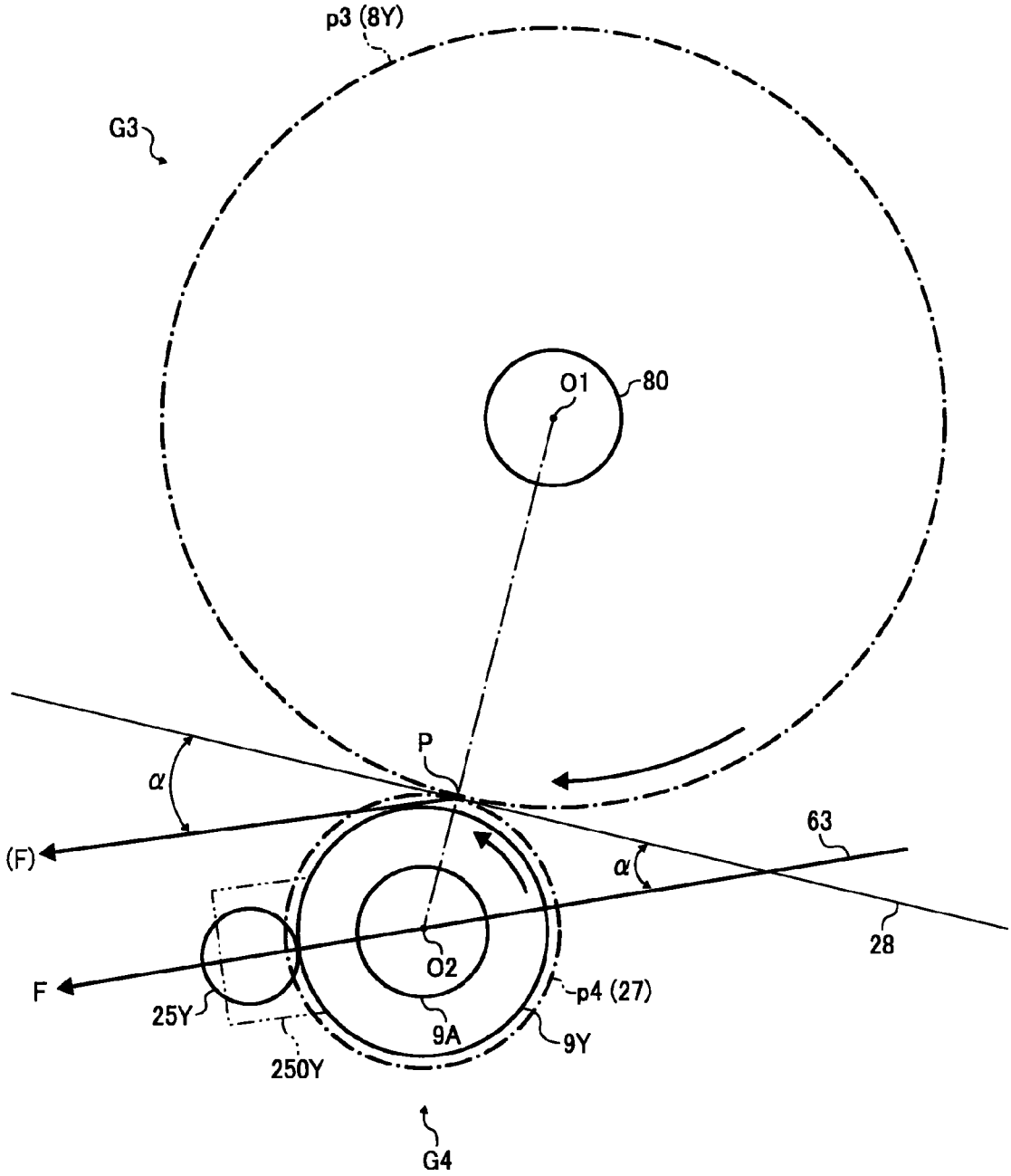
FIG. 7 is a schematic view of the charging roller and a charging roller cleaner included in the charging device shown in FIG. 4.
Figure 8:
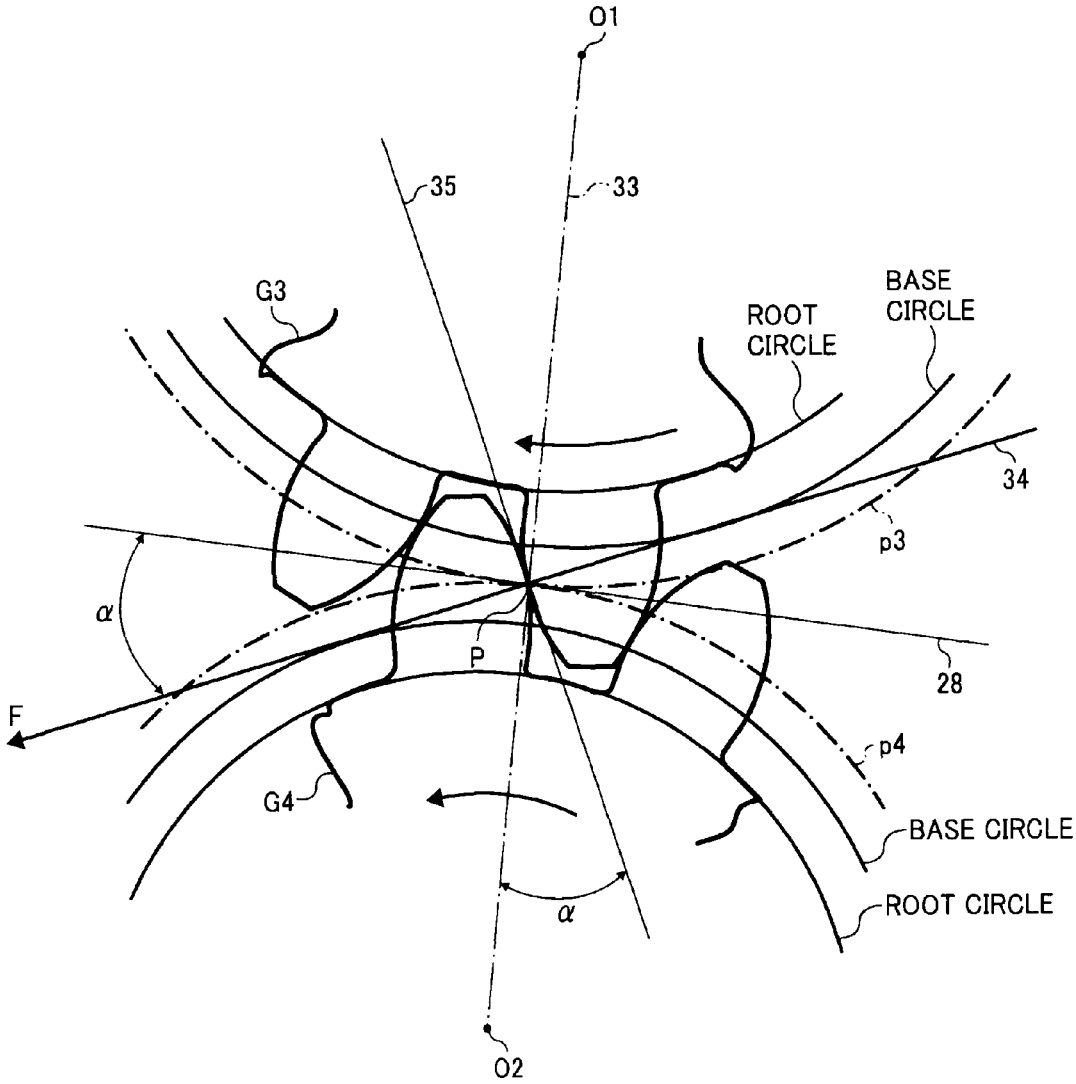
FIG. 8 is an enlarged partial view of the photoconductor gear and the driven gear engaging each other.
Figure 9:
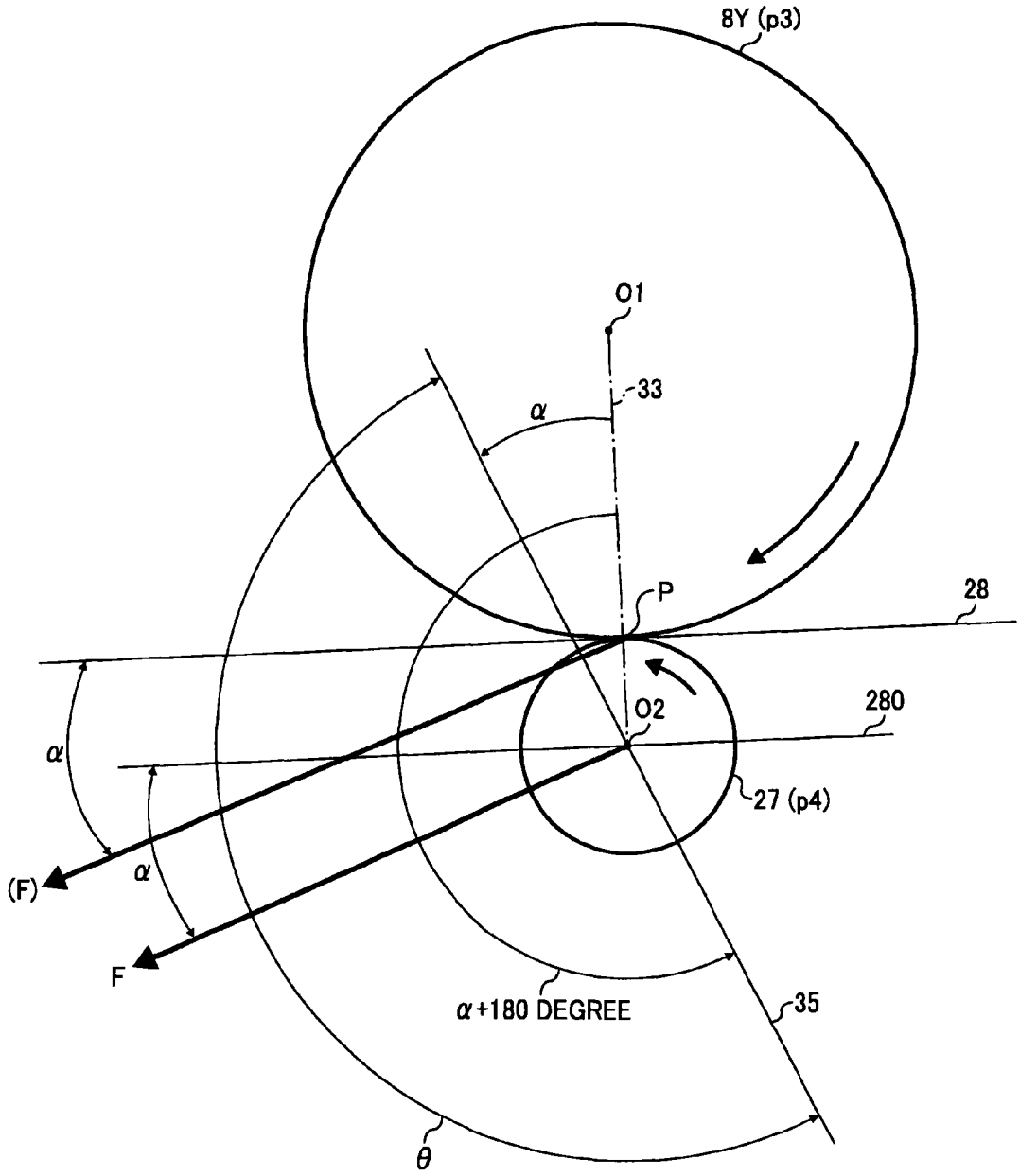
FIG. 9 is a schematic view of the photoconductor and the charging roller illustrating an angle θ.

Referring to FIGS. 7, 8, and 9, a description is now given of arrangement of the charging roller cleaner 25Y. FIG. 7 is a schematic view of the pitch circle p3 of the photoconductor gear G3, the pitch circle p4 of the driven gear G4, the charging roller 9Y, and the charging roller cleaner 25Y (250Y).

As can be seen in the drawings, the roller-shaped charging roller cleaner 25Y or the block-shaped non-rotatable charging roller cleaner 250Y contacts a rear surface of the charging roller 9Y in a direction opposite to the direction of the force F. Such an arrangement prevents displacement of the charging roller 9Y due to the force F generated by the pressure angle formed by the meshing of the driven gear G4 and the photoconductor gear G3 with the driven gear G4 when the charging roller 9Y is driven with the rotation of the photoconductor 8Y. Therefore, since the charging roller cleaner 25Y or the charging roller cleaner 250Y is provided in the direction of the force F generated by the pressure angle α, the charging roller cleaner 25Y or the charging roller cleaner 250Y prevents the charging roller 9Y from separating from the photoconductor 8Y due to the force F, thereby maintaining a predetermined gap between the surfaces of the photoconductor 8Y and the charging roller 9Y at a predetermined distance, as well as cleaning the surface of the charging roller 9Y.

The direction of the force F generated by the pressure angle α is described in greater detail with reference to FIG. 8. FIG. 8 illustrates a state of engagement between the photoconductor gear G3 and the driven gear G4. As rotation proceeds, the common contact point P moves along a line of action 34 indicating a common tangent line to each base circle of the photoconductor gear G3 and the driven gear G4. When the common contact point P is on the line segment 33, the line of action 34 is perpendicular to a common tangent line 35 to each tooth surface of the photoconductor gear G3 and the driven gear G4 having an involute curve of both gears.

Both angles between the common tangent line 28 and the line of action 34 and between the common tangent line 35 and the line of segment 33 form the pressure angle α. The force F generated by the pressure angle α acts in a direction of inclination of the line of action 34 indicating a common tangent line to each base circle of both the gears G3 and G4 with respect to the common tangent line 28 to the pitch circle p3 of the photoconductor gear G3 and the pitch circle p4 of the driven gear G4, thereby causing the charging roller 9Y to separate from the photoconductor 8Y. That is, the force F acts in a counterclockwise direction of rotation of the driven gear G4.

Accordingly, as illustrated in FIG. 7, the charging roller cleaner 25 or the charging roller cleaner 250 is preferably provided such that a center of the charging roller cleaner 25 or the charging roller cleaner 250 is on a reference line 63 passing though the center O2 of the driven gear G4, serving as a center of the charging roller 9Y, and forming the pressure angle α with respect to the common tangent line 28. Therefore, the charging roller cleaner 25 or the charging roller cleaner 250 contacts the rear surface of the charging roller 9Y against the direction of the force F.

Moreover, even though the charging roller cleaner 25 or the charging roller cleaner 250 could shift from the above position due to misalignment within a tolerance range during manufacturing and assembly of components, or among various components provided around the photoconductor 8Y, when the charging roller cleaner 25 or the charging roller cleaner 250 is provided in a range of action of the Fx and Fy force components depicted in FIG. 6, the charging roller 9Y is prevented from separating from the photoconductor 8Y.

FIG. 9 is a schematic view of the photoconductor 8Y and the spacer 27 illustrating a range of action of the Fx and Fy component forces. The Fx and Fy component forces of the force F generated by the pressure angle α are effective in an area indicated by an angle θ to the left of the common tangent line 35 perpendicular to the direction of the force F, passing through the center O2 of the driven gear G4. Thus, the charging roller cleaner 25 or the charging roller cleaner 250 contacts the surface of the charging roller 9Y within the area of the angle θ.

As illustrated in FIG. 9, a line segment 280 is parallel to the common tangent line 28 and passes through the center O2 of the driven gear G4. The area of the angle θ corresponds to an area of 90 degrees inclined from the direction of the force F clockwise and counterclockwise, that is, a left semicircular portion of the charging roller 9Y divided by the common tangent line 35 perpendicular to the direction of the force F and passing though the center O2 of the driven gear G4. Therefore, since the charging roller cleaner 25 or the charging roller cleaner 250 contacts the surface of the charging roller 9Y within the area of the angle θ, as illustrated in FIG. 7, the charging roller 9Y is prevented from separating from the photoconductor 8Y.

Accordingly, such provision of the charging roller cleaner 25 or the charging roller cleaner 250 in the area of the angle θ can suppress the Fx and Fy components of the force F. The area of the angle θ can be easily defined by using the center O1 of the photoconductor 8Y, the center O2 of the charging roller 9Y, and the pressure angle α.

If an angle formed between the line of segment 33 connecting the center O1 of the photoconductor 8Y with the center O2 of the charging roller 9Y and a contact point of the charging roller cleaner 25 or 250 and the charging roller 9Y in a direction in which the charging roller 9Y rotates around the center O2 is β, then, as can be seen from FIGS. 8 and 9, a relation between the angle β and the pressure angle α is represented as $$\alpha<\beta<\alpha+180 \text{ degrees}$$

Therefore, when the angle β satisfies this condition, the charging roller cleaner 25 or 250 can be provided within the area of the angle θ.

Figure 10:
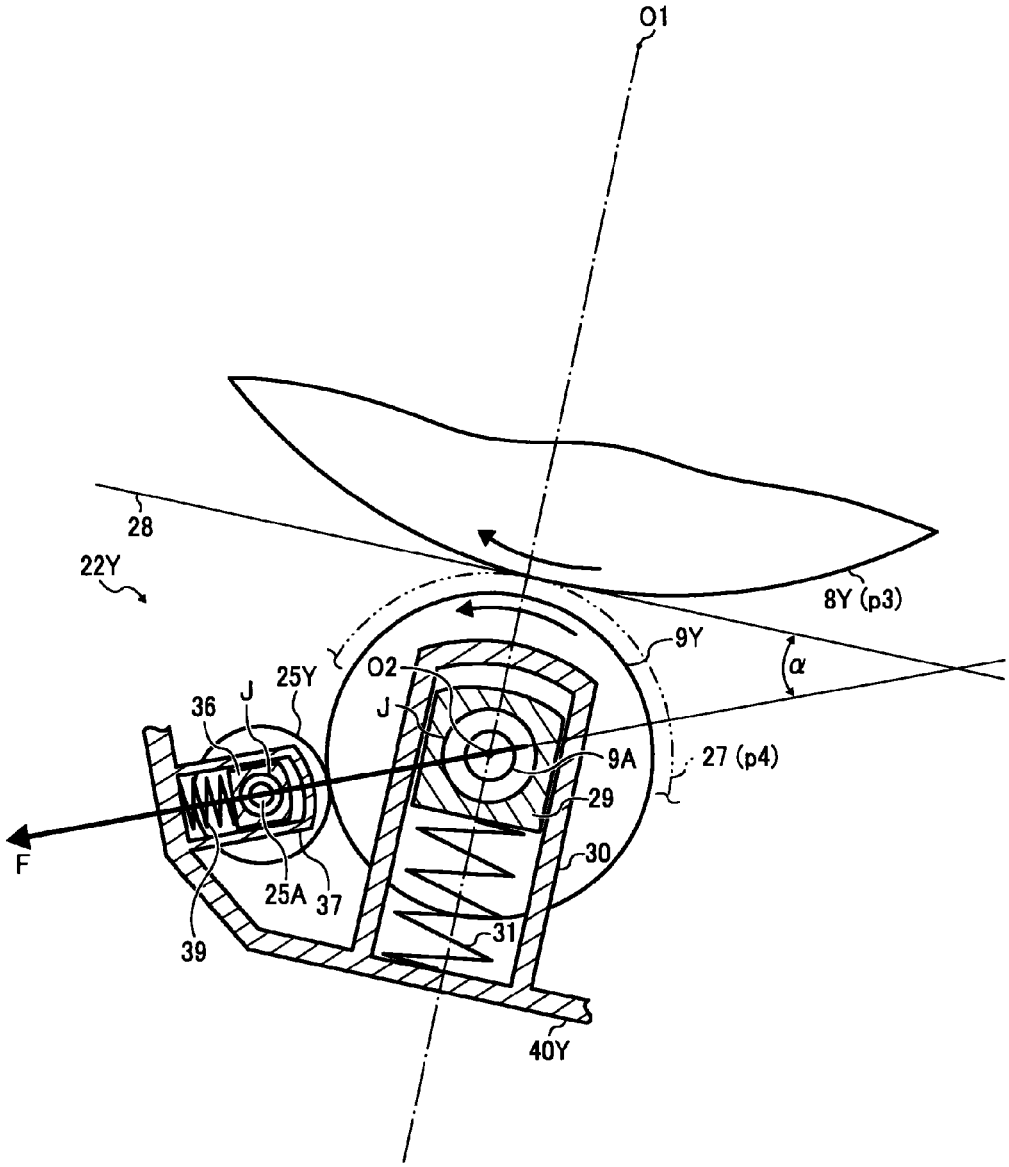
FIG. 10 is a schematic sectional view of the charging device shown in FIG. 4.
Figure 11:
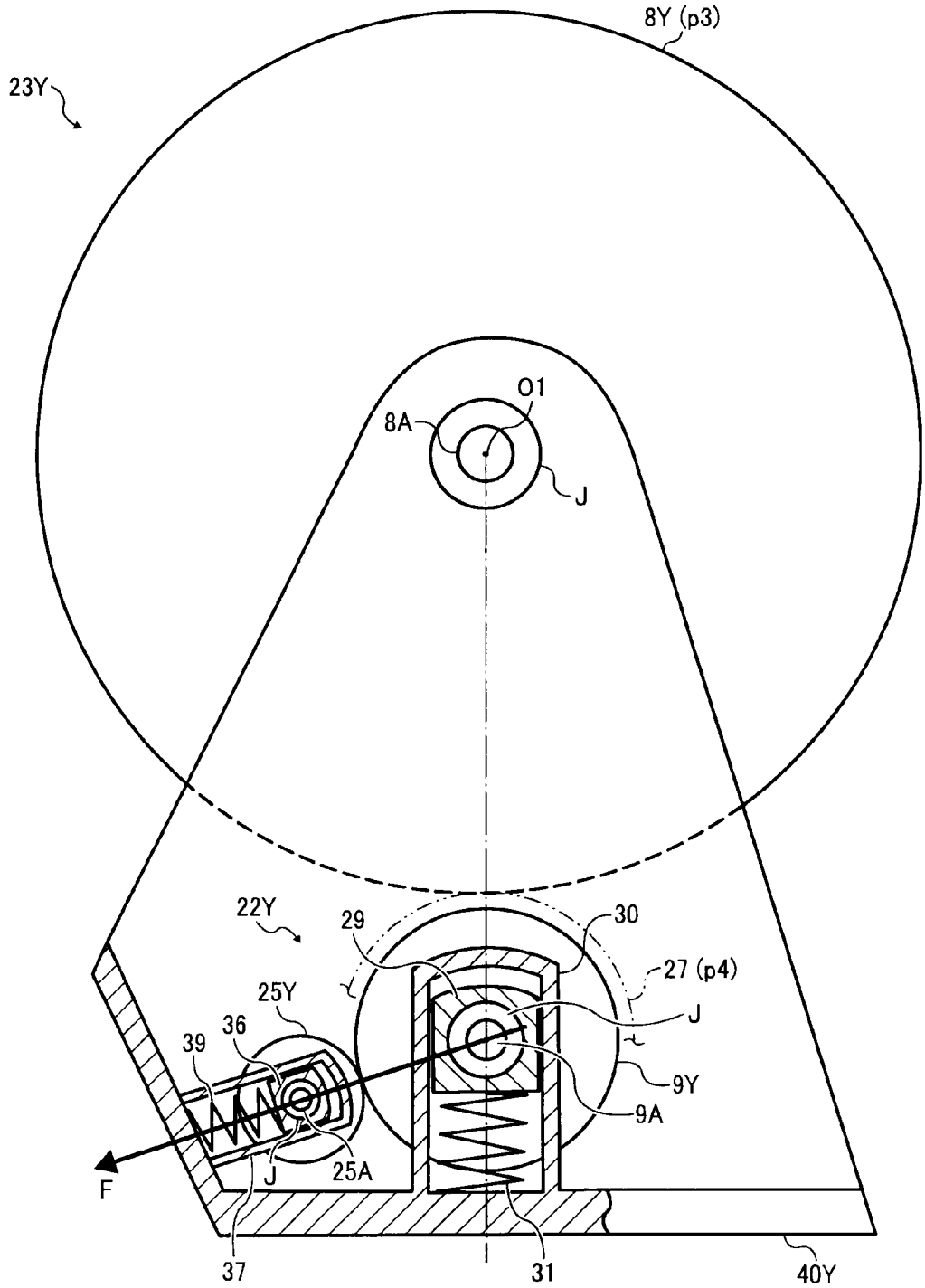
FIG. 11 is a schematic sectional view of a process cartridge including the charging device shown in FIG. 10.
Figure 12:
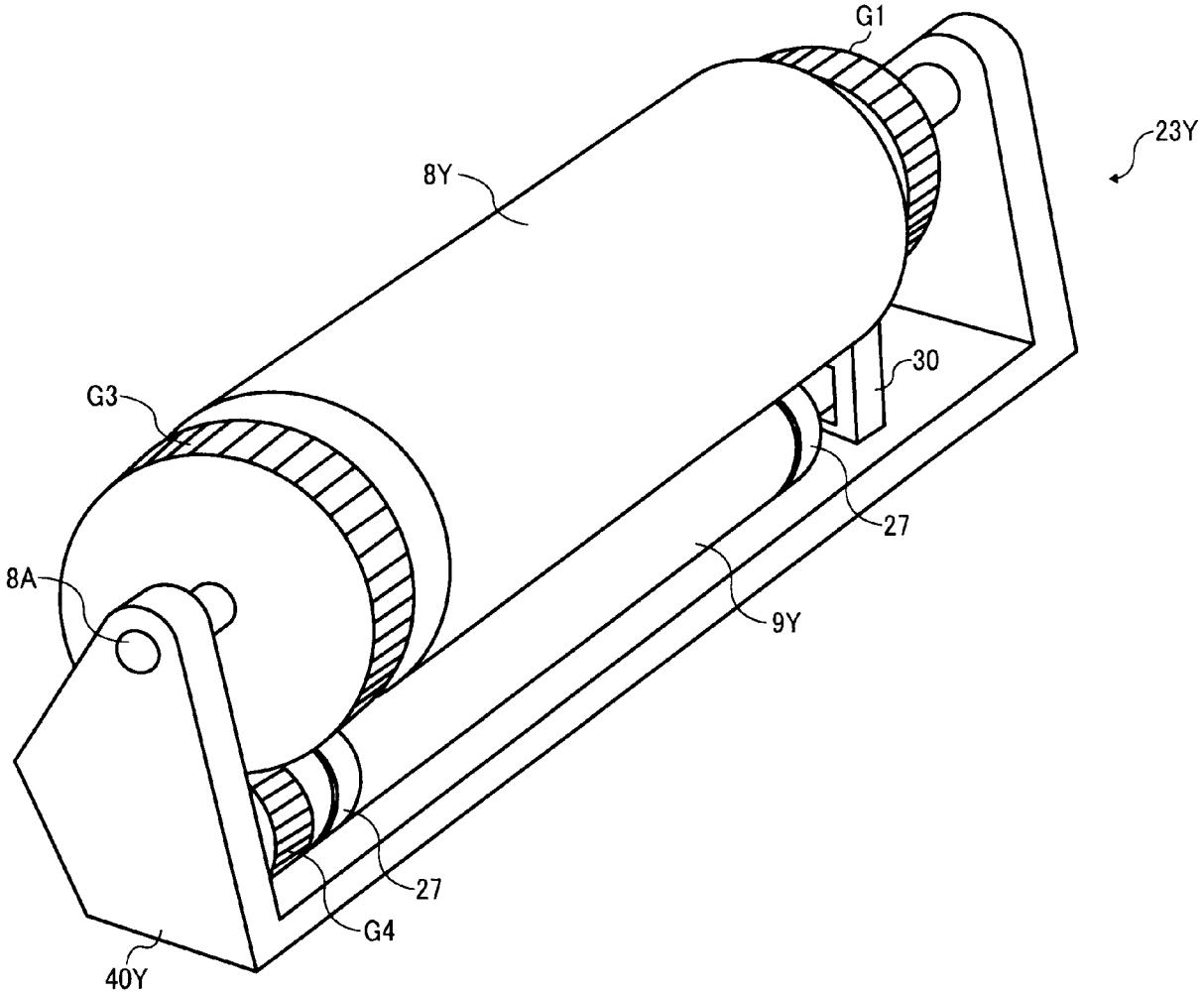
FIG. 12 is a perspective view of the process cartridge shown in FIG. 11.

Referring to FIGS. 10, 11, and 12, a description is now given of configurations of the charging device 22Y and the process cartridge 23Y. FIG. 10 is a schematic sectional view of the charging device 22Y. The charging roller cleaner 25Y further includes a movable member 36, a guide member 37, and a biasing member 39.

Since the charging roller cleaner 25Y is roller-shaped, the charging roller cleaner 25Y can stably clean the charging roller 9Y in a longitudinal direction of the charging roller 9Y for a long period of time. In addition, since a contact position between the charging roller cleaner 25Y and the charging roller varies with the rotation of the charging roller cleaner 25Y, the charging roller cleaner 25Y has a longer service life than when the charging roller cleaner 25Y is not roller-shaped.

According to the illustrative embodiment, since the charging roller cleaner 25Y is automatically driven to rotate with the rotation of the charging roller 9Y, the charging roller cleaner 25Y does not need any driving member, thereby decreasing the cost of the charging device 22Y. It is to be noted that a configuration of the charging roller 9Y supported by the movable member 29, the guide member 30, the biasing member 31, and the like, as illustrated in FIG. 10, is described above with reference to FIG. 6, and thus a description thereof is omitted here.

As illustrated in FIG. 4, the charging roller cleaner 25 has a length not greater than a distance between the spacers 27 provided at both ends of the charging roller 9Y in an axial direction of the charging roller 9Y. As with the charging roller 9Y, the charging roller cleaner 25Y is supported by the movable member 36, the guide member 37, the biasing member 39, and the like. The charging roller cleaner 25Y contacts the rear surface of the charging roller 9Y in a direction opposite to the direction of the force F passing through the center O2 of the driven gear G4 of the charging roller 9Y and forming the pressure angle α with respect to the common tangent line 28.

The central shaft 25A of the charging roller cleaner 25Y is supported by a bearing J held by the movable member 36. The guide member 37 guides the movable member 36 such that a center of the central shaft 25A is provided in the direction of the force F passing the center O2 of the driven gear G4 of the charging roller 9Y and forming the pressure angle α with respect to the common tangent line 28.

The biasing member 39 includes an elastic spring, and presses the movable member 36 toward the center O2 of the driven gear G4 against the direction of the force F. The biasing member 39 has force greater than the force F, so as not to displace the charging roller 9Y. The guide member 37 is provided in the process cartridge 23Y or the body 2 of the image forming apparatus 1. It is to be noted that the charging roller cleaner 25Y may be provided at any position within the area of the angle θ, as illustrated in FIG. 9. As illustrated in FIG. 3, the charging device 22Y is combined with the process cartridge 23Y detachably attachable to the image forming apparatus 1, or independently provided in the body 2 of the image forming apparatus 1 as a separate component.

Since the charging roller cleaner 25Y is movable in the direction of the force F generated by the pressure angle α and pressed toward the charging roller 9Y by the biasing member 39 against the direction of the force F, the charging roller cleaner 25Y can clean the charging roller 9Y as well as prevent displacement of the charging roller 9Y due to the force F.

FIG. 11 is a schematic sectional view of the process cartridge 23Y. FIG. 12 is a perspective view of the process cartridge 23Y. As illustrated in FIGS. 11 and 12, when the process cartridge 23Y includes the frame 40Y mounting the photoconductor 8Y, the guide member 30 supporting the charging roller 9Y, the guide member 37 supporting the charging roller cleaner 25Y, and the like, the process cartridge 23Y including the charging device 22Y is detachably attachable to the image forming apparatus 1. The process cartridge 23Y is accessible by opening the side cover 26, as illustrated in FIG. 3. It is to be noted that the development device 10 and the cleaning device 11 depicted in FIG. 2 also may be combined with the process cartridge 23Y.

According to the illustrative embodiment, the process cartridge 23Y includes the charging device 22Y efficiently cleaning the charging roller 9Y to stably charge the photoconductor 8Y for a long period of time, thereby extending the life of the process cartridge 23Y. In addition, the image forming apparatus 1 includes the process cartridge 23Y including the charging device 22Y, thereby facilitating maintenance of the image forming apparatus 1 as well as extending the life of the image forming apparatus 1. In addition, the image forming apparatus 1 includes the charging device 22Y efficiently cleaning the charging roller 9Y, thereby providing high-quality imaging for a long period of time.

Figure 13:
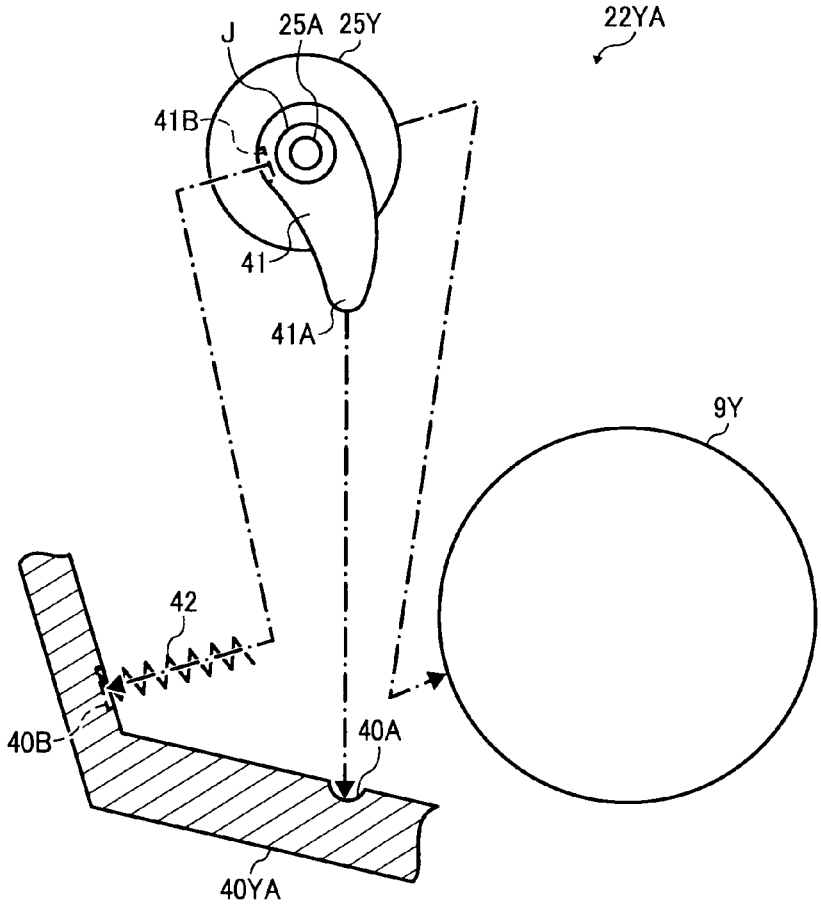
FIG. 13 is an exploded view of a modification example of the charging device shown in FIG. 11.
Figure 14:
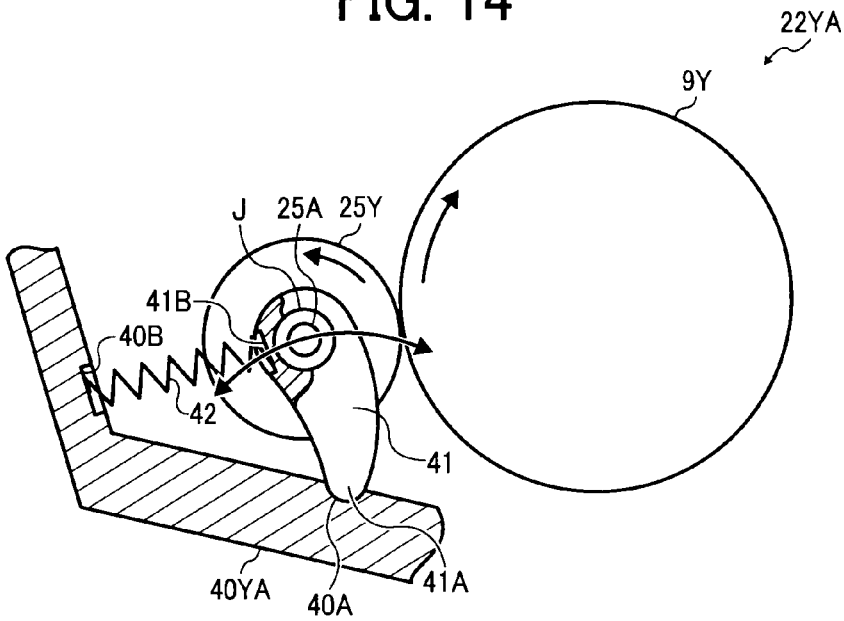
FIG. 14 is a schematic view of the charging device show in FIG. 13.
Figure 15:
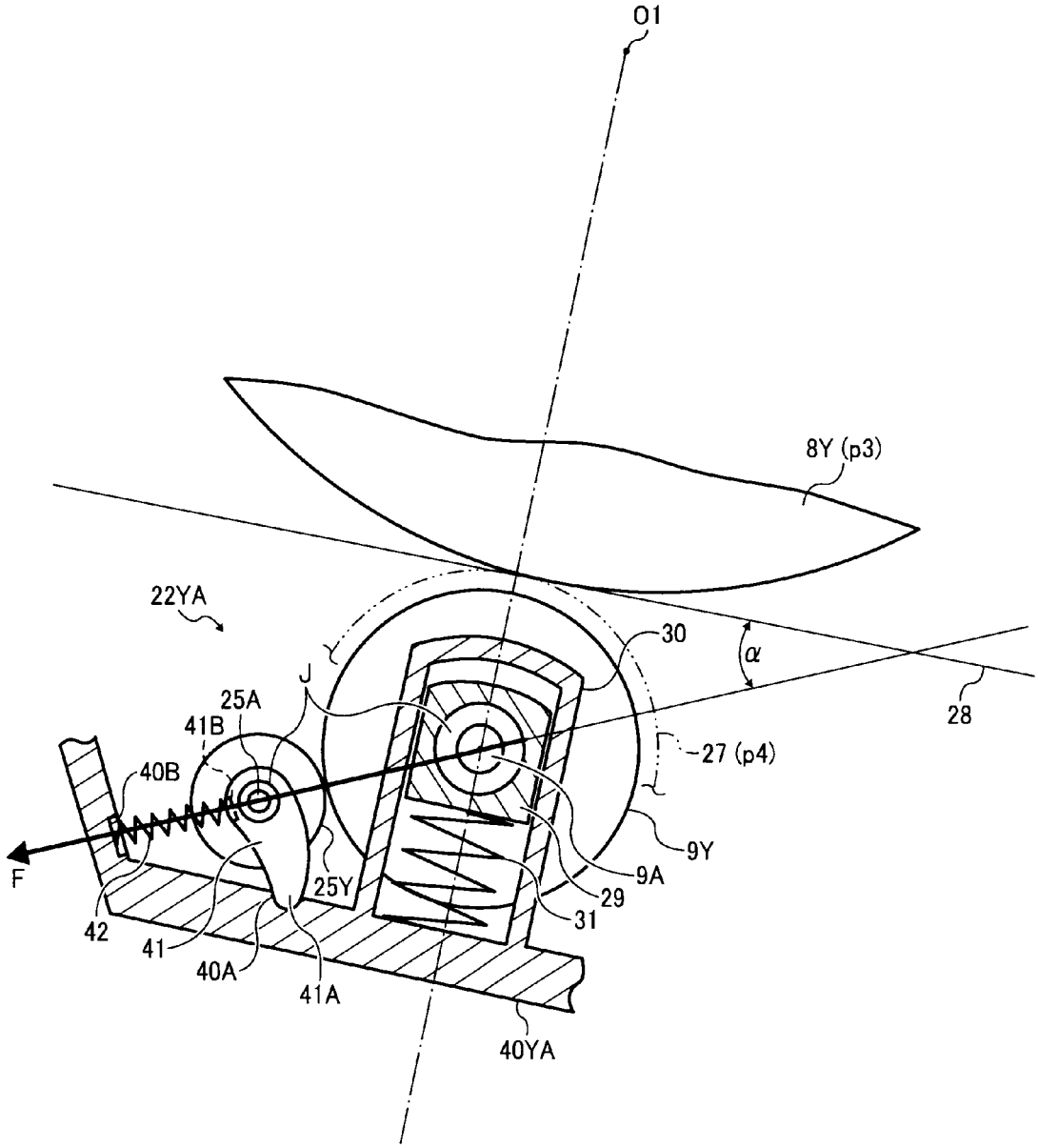
FIG. 15 is a schematic sectional view of the charging device shown in FIG. 14.

Referring to FIGS. 13, 14, 15, and 16, a description is now given of a charging device 22YA according to another illustrative embodiment of the present invention. FIG. 13 is an exploded view of the charging device 22YA. FIG. 14 is a schematic view of the charging device 22YA. FIG. 15 is a schematic sectional view of the charging device 22YA. The charging roller cleaner 25Y includes a pivoting member 41 and a biasing member 42. The pivoting member 41 includes a free edge 41A and a concave portion 41B. A frame 40YA includes a concave portion 40A and a seating portion 40B.

The charging roller cleaner 25Y is supported by the plate-like pivoting members 41 via the bearing J at both ends of the central shaft 25A in a longitudinal direction of the central shaft 25A, respectively. The pivoting member 41 has a plate-like shape, and the free edge 41A of the pivoting member 41 includes a semicircular curved surface. The semicircular concave portion 40A is provided on an upper surface of the frame 40YA to engage the free edge 41A of the pivoting member 41. The concave portion 41B is provided in the vicinity of a position of the pivoting member 41 at which the bearing J supports the central shaft 25A, and holds one end of the biasing member 42. Another end of the biasing member 42 is fixed to the seating portion 40B of the frame 40YA.

The biasing member 42 includes an elastic spring. When the concave portion 40A of the frame 40YA engages the free edge 41A of the pivoting member 41 provided at both ends of the central shaft 25A in the longitudinal direction of the central shaft 25A, by pressing one end of the biasing member 42 into the concave portion 41B of the pivoting member 41, the charging roller cleaner 25Y is installed in the frame 40YA, as illustrated in FIG. 14.

As a result, the charging roller cleaner 25Y is pivotable around the free edge 41A, as illustrated in FIG. 14. When the charging roller cleaner 25Y is pressed toward and against the charging roller 9Y by elastic force of the biasing member 42, the charging roller cleaner 25Y is rotatable with the rotation of the charging roller 9Y.

By appropriately setting positions of the biasing member 42 and the concave portion 40A, and a distance from the free edge 41A to the central shaft 25A, the charging roller cleaner 25Y contacts the rear surface of the charging roller in a direction in which the charging roller cleaner 25Y is pressed toward the charging roller 9Y by the biasing member 42 to oppose the direction of the force F passing through the center O2 of the driven gear G4 of the charging roller 9Y and forming the pressure angle $\alpha$ relative to the common tangent line 28, as illustrated in FIG. 15.

The charging device 22YA as described above can be easily assembled by fixing the free edge 41A of the pivoting member 41 to the concave portion 40A of the frame 40YA, and fixing one end of the biasing member 42 to the seating portion 40B of the frame 40YA while pressing another end of the biasing member 42 into the concave portion 41B of the pivoting member 41. It is to be noted that when the pivoting members 41 provided at both ends of the central shaft 25A in the longitudinal direction of the central shaft 25A are connected to each other with an appropriate member, both the pivoting members 41 pivot in a same phase, thereby facilitating assembly of the charging device 22YA as well as increasing stability of the charging device 22YA.

Figure 16:
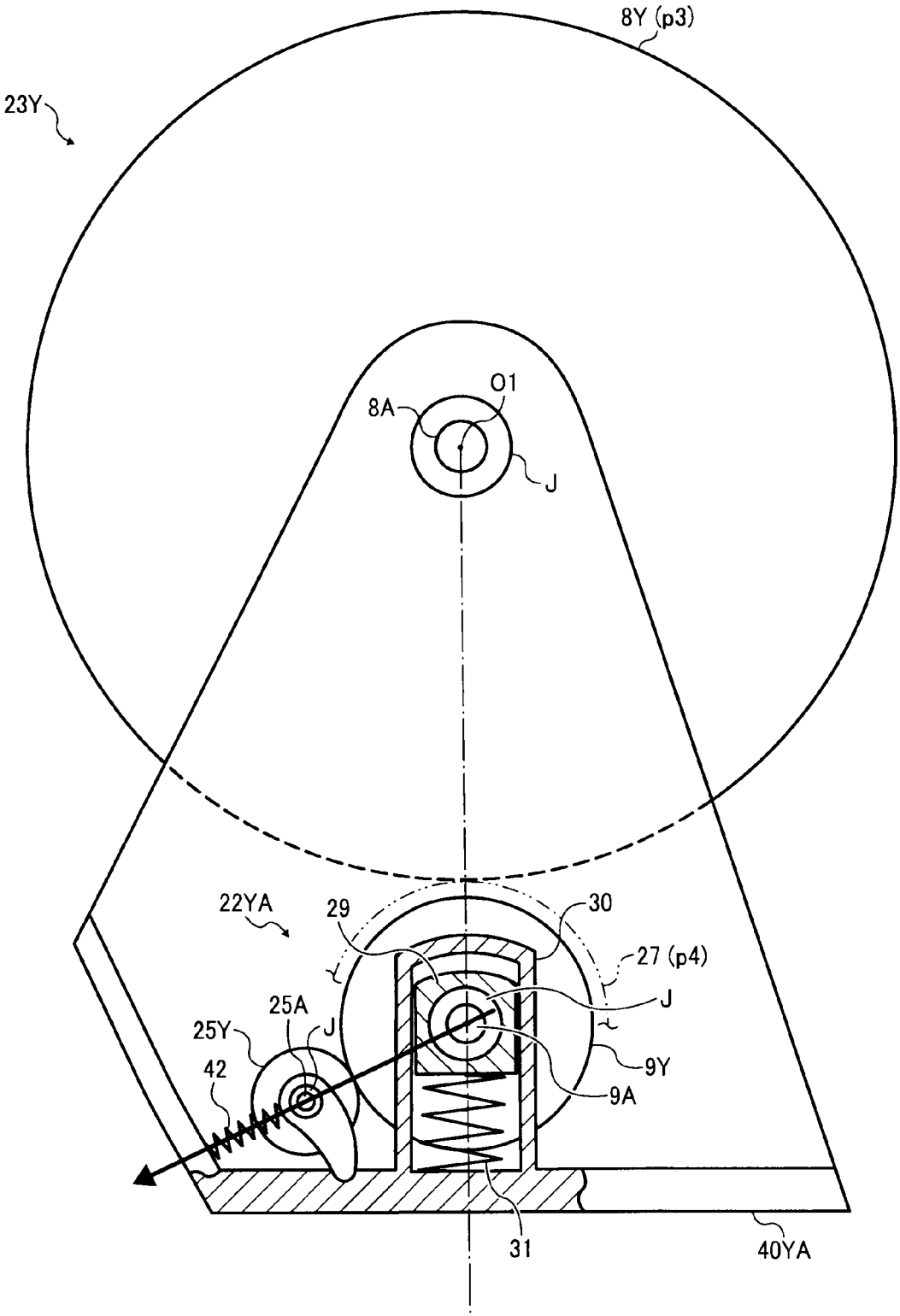
FIG. 16 is a schematic sectional view of a process cartridge including the charging device shown in FIG. 15.

The biasing member 42 presses the charging roller cleaner 25Y to prevent displacement of the charging roller 9Y due to the force F. The pivoting member 41 and the biasing member 42 are provided in the process cartridge 23Y or the body 2 of the image forming apparatus 1. The charging roller cleaner 25Y is provided in the area of the angle $\theta$ depicted in FIG. 9 to oppose the Fx and Fy force components of the force F. The charging device 22YA is combined with the process cartridge 23Y detachably attachable to the image forming apparatus 1 or independently provided in the body 2 of the image forming apparatus 1 as a separate component. FIG. 16 is a schematic sectional view of the process cartridge 23Y combining the charging device 22YA.

According to the illustrative embodiment, since the charging roller cleaner 25Y is movable in the direction of the force F generated by the pressure angle $\alpha$ while being pressed by the biasing member 42 toward the charging roller 9Y against the direction of the force F, the charging roller cleaner 25Y efficiently cleans the charging roller 9Y as well as prevents the charging roller 9Y from displacing due to the force F.

Figure 17:
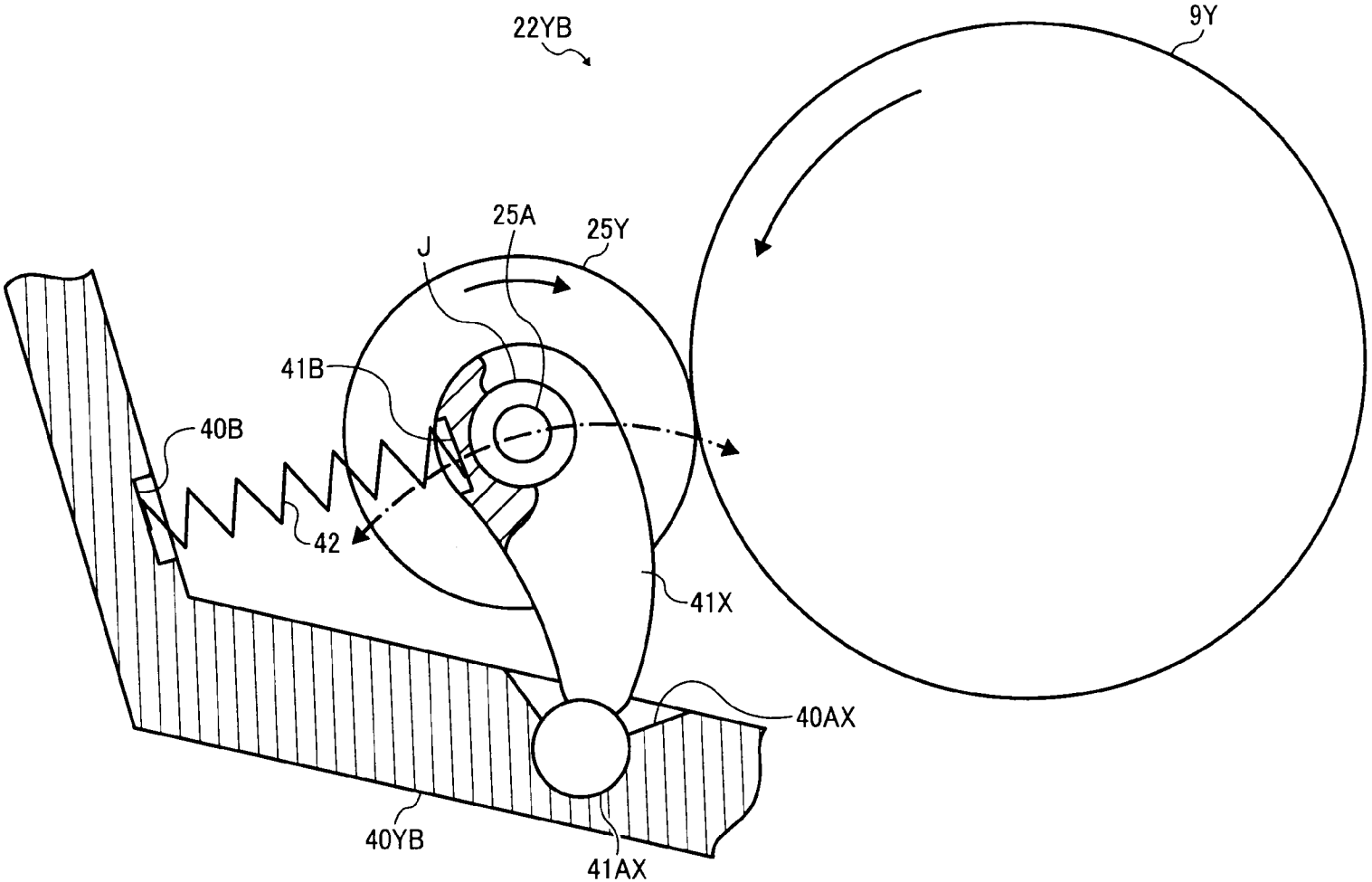
FIG. 17 is a schematic view of a modification example of the charging device shown in FIG. 16.
Figure 18:
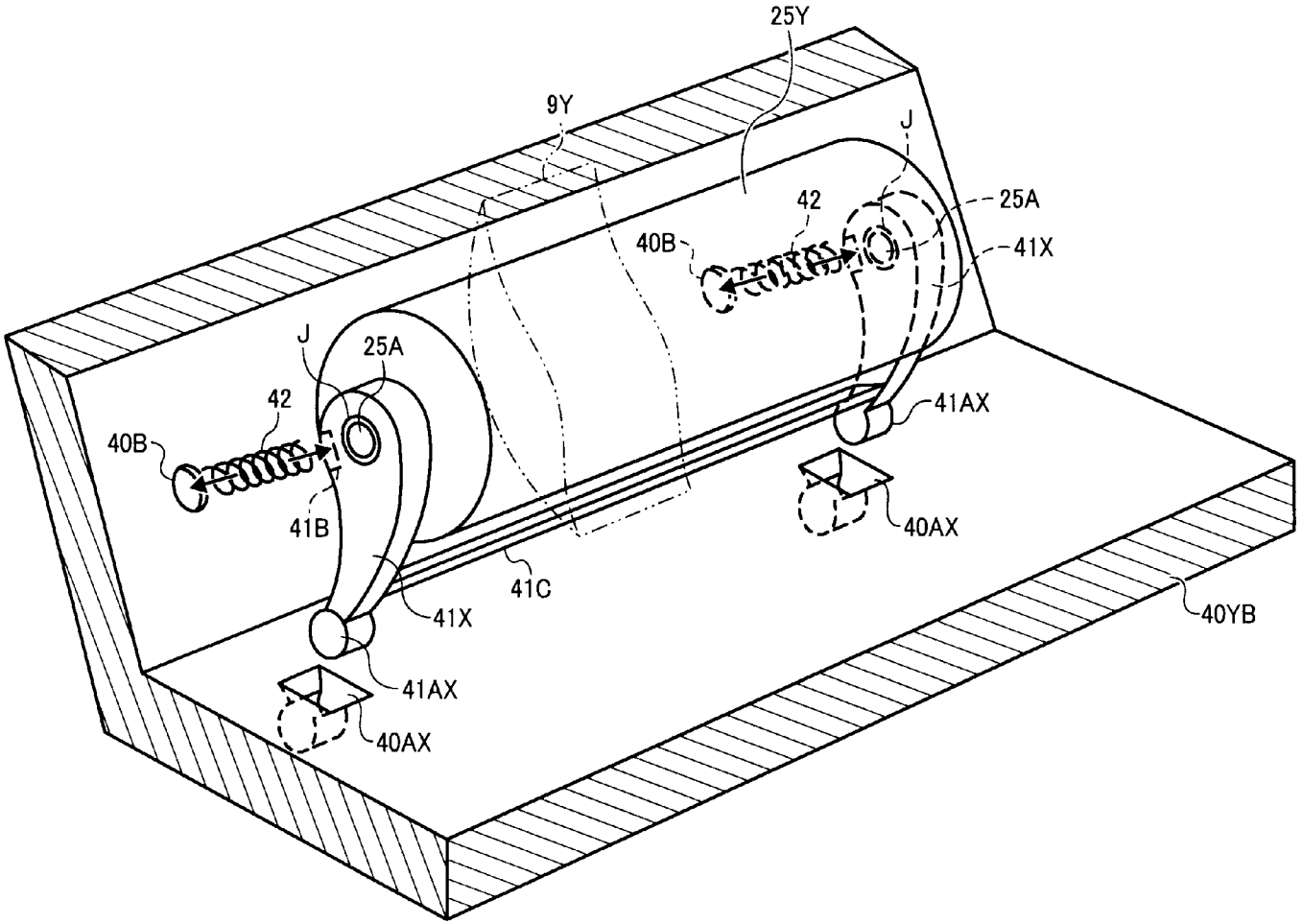
FIG. 18 is an exploded perspective view of the charging device shown in FIG. 17.

Referring to FIGS. 17 and 18, a description is now given of a charging device 22YB according to yet another illustrative embodiment.

In the charging device depicted in FIG. 14, the free edge 41A of the pivoting member 41 has a semicircular curved surface to fit the semicircular concave portion 40A formed on the upper surface of the frame 40YA. Therefore, when the charging roller cleaner 25Y rotates with the rotation of the charging roller 9Y, the free edge 41A of the pivoting member 41 receives a force that tends to separate it from the concave portion 40A. In this case, an engagement portion, that is, the concave portion 40A may be made deeper, or an appropriate stopper may be provided.

FIG. 17 is a schematic sectional view of the charging device 22YB and a frame 40YB. FIG. 18 is an exploded perspective view of the charging roller cleaner 25Y and the frame 40YB. The charging device 22YB includes a pivoting member 41X. The frame 40YB includes a concave portion 40AX. The pivoting member 41X includes a free edge 41AX and a connecting member 41C.

The free edge 41AX of the pivoting member 41X has a substantially circular rather than a semicircular shape, so as to form a constricted portion adjacent to the circular portion of the free edge 41AX, thereby preventing the pivoting member 41X from separating from the concave portion 40AX. The concave portion 40AX also includes a constricted portion to engage the free edge 41AX of the pivoting member 41X, thereby preventing the pivoting member 41X from separating from the concave portion 40AX.

Such constricted portions of the pivoting member 41X and the concave portion 40AX prevent the pivoting member 41X from separating from the concave portion 40AX. However, when the free edge 41AX and the concave portion 40AX are extremely constricted, it becomes difficult to assemble the charging device 22YB. Thus, the pivoting member 41X and the concave portion 40AX are constricted only to a degree necessary to provide stable attachment of the charging roller cleaner 25Y.

In addition, the pivoting member 41X may include an elastically deformable member such as a resin. The other configurations of the charging device 22YB are equivalent to those of the charging device 22YA depicted in FIG. 13.

As illustrated in FIG. 18, the connecting member 41C is provided between the pivoting members 41 provided at both ends of the central shaft 25A in the longitudinal direction of the central shaft 25A to connect both the pivoting members 41 with each other.

According to the above illustrative embodiments, a contact portion of the charging roller cleaner 25Y contacting the charging roller 9Y includes melamine resin foam. By providing the melamine resin foam in the charging roller cleaner 25Y, the charging roller cleaner 25Y can stably clean the charging roller 9Y for a long period of time even when a surface of the charging roller cleaner 25Y wears over time.

Figure 19:
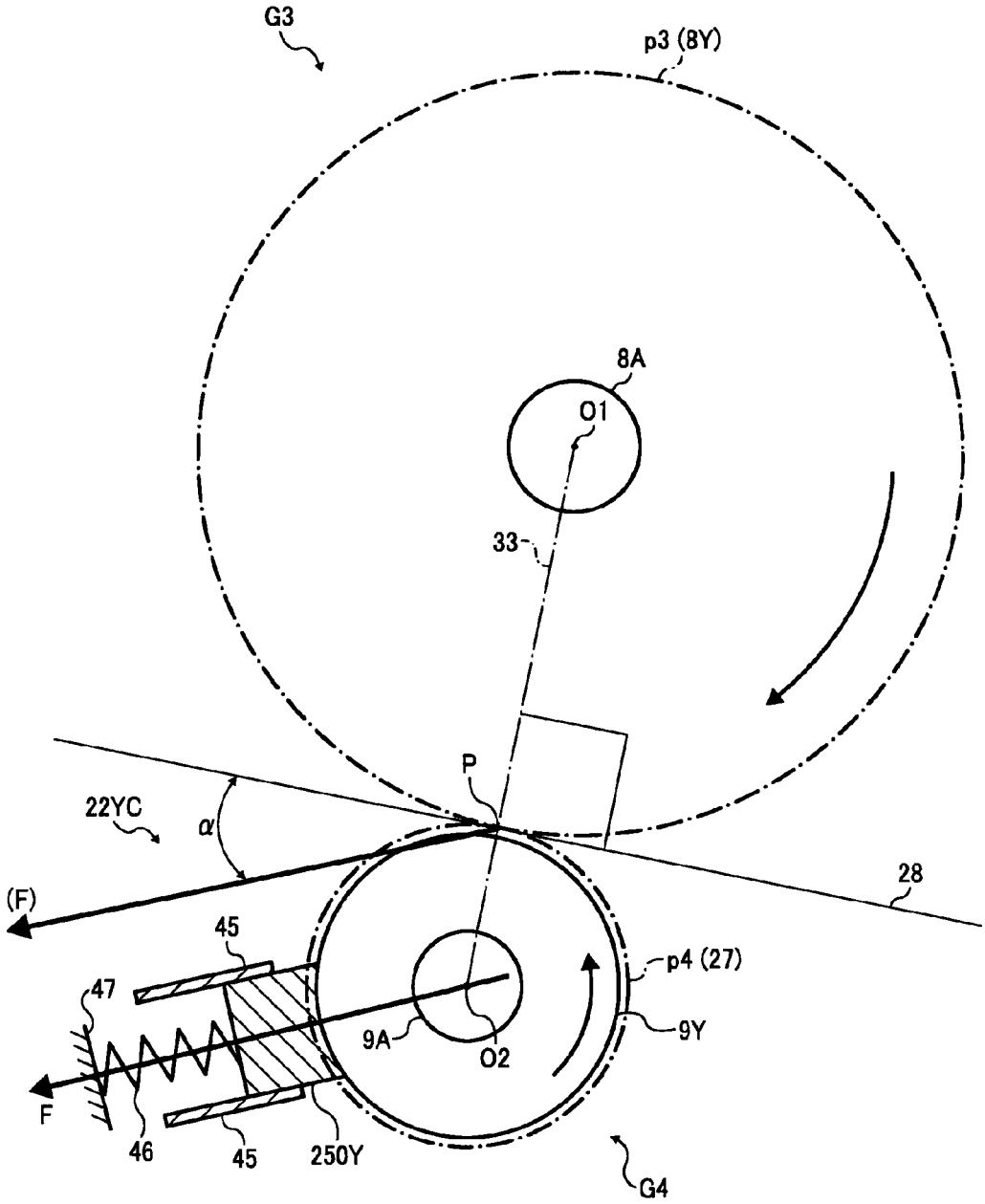
FIG. 19 is schematic view of a charging roller cleaner according to another illustrative embodiment of the present invention.

Referring to FIG. 19, a description is now given of a charging device 22YC in which the charging roller cleaner is an irrotational block.

FIG. 19 is a schematic sectional view of the charging device 22YC. The charging device 22YC includes a guide member 45, a biasing member 46, and a frame member 47. The charging device 22YC includes the charging roller cleaner 250Y depicted in FIG. 7.

The charging roller 9Y is supported by the movable member 29, the guide member 30, the biasing member 31, and the like depicted in FIG. 6 as described above, and thus a description thereof is omitted here.

The block-shaped irrotational charging roller cleaner 250Y has a length not greater than a distance between the spacers 27 provided at both ends of the charging roller 9Y in an axial direction of the charging roller 9Y, as illustrated in FIG. 4. The charging roller cleaner 250 contacts the rear surface of the charging roller 9Y in a direction opposite to the direction of the force F passing through the center O2 of the driven gear G4 of the charging roller 9Y and forming the pressure angle $\alpha$ with respect to the common tangent line 28 as described above with reference to FIG. 7.

The charging roller cleaner 250Y has a substantially rectangular parallelepiped shape. The guide member 45 controls a direction of movement of the charging roller cleaner 250Y, and the biasing member 46 presses the charging roller cleaner 250Y toward and against the charging roller 9Y against the direction of the force F, so that the charging roller cleaner 250Y contacts the rear surface of the charging roller 9Y in a direction opposite to the direction of the force F. A contact portion of the charging roller cleaner 250Y contacting the charging roller 9Y includes melamine resin foam.

The biasing member 39 has elastic force to prevent displacement of the charging roller 9Y due to the force F. The guide members 45 and the frame member 47 holding one end of the biasing member 46 are provided in the process cartridge 23Y depicted in FIG. 16 or the body 2 of the image forming apparatus 1. It is to be noted that the charging roller cleaner 250Y may be provided in the area in which the charging roller cleaner 250Y receives the Fx and Fy force components of the force F. The charging device 22YC is combined with the process cartridge 23Y detachably attachable to the image forming apparatus 1, or independently provided in the body 2 of the image forming apparatus 1.

According to the illustrative embodiment, since the charging roller cleaner 250Y is movable in the direction of the force F generated by the pressure angle $\alpha$ and pressed by the biasing member 46 toward the charging roller 9Y against the direction of the force F, the charging roller cleaner 250Y efficiently cleans the charging roller 9Y while preventing the charging roller 9Y from separating from the photoconductor 8Y due to the force F.

According to the illustrative embodiments, by providing a charging roller cleaner, for example, the charging roller cleaners 25Y and 250Y depicted in FIGS. 11 and 19, positioned in a direction of force forming a pressure angle generated by a gear, for example, the gears G3 and G4 depicted in FIG. 4, the charging roller cleaner effectively cleans a charging roller, for example, the charging roller 9Y depicted in FIG. 11, as well as prevents an increase in a size of a gap between a surface of a photoconductor, for example, the photoconductor 8Y depicted in FIG. 11, and a surface of the charging roller.

As can be appreciated by those skilled in the art, although the present invention has been described above with reference to specific illustrative embodiments the present invention is not limited to the specific embodiments described above, and various modifications and enhancements are possible without departing from the scope of the invention. It is therefore to be understood that the present invention may be practiced otherwise than as specifically described herein. For example, elements and/or features of different illustrative embodiments may be combined with each other and/or substituted for each other within the scope of the present invention.

What is claimed is:

1. A charging device, comprising:

a charging roller configured to oppose an image carrier driven to rotate and rotate to charge the image carrier;

a drive transmission device configured to transmit torque from the image carrier to the charging roller; and a charging roller cleaner configured to contact the charging roller to clean the charging roller, the drive transmission device comprising:

an image carrier gear supported by the image carrier; and a driven gear supported by the charging roller, the image carrier gear and the driven gear forming a gear train to drive the charging roller in response to rotation of the image carrier, the charging roller cleaner disposed facing a rear surface of the charging roller in a position to prevent displacement of the charging roller due to a force generated by a pressure angle formed between the image carrier gear and the driven gear as the image carrier gear and the driven gear mesh when the charging roller rotates in response to rotation of the image carrier.

2. The charging device according to claim 1, wherein the charging roller cleaner is provided in a range of force components of the force generated by the pressure angle.

3. The charging device according to claim 2, wherein the charging roller cleaner is provided in a position satisfying a relation of $\alpha<\beta<\alpha+180$ degrees, wherein $\alpha$ represents the pressure angle and $\beta$ represents an angle formed between a line connecting a center of the image carrier with a center of the charging roller and a contact position between the charging roller cleaner and the charging roller in a direction of rotation of the charging roller.

4. The charging device according to claim 1, wherein the charging roller cleaner is movable in a direction of the force generated by the pressure angle and pressed in a direction opposite to the direction of the force generated by the pressure angle.

5. The charging device according to claim 1, wherein the charging roller cleaner is roller-shaped.

6. The charging device according to claim 1, wherein the charging roller cleaner is block-shaped and irrotatable.

7. The charging device according to claim 1, wherein a contact portion of the charging roller cleaner with the charging roller includes melamine resin foam.

8. The charging device according to claim 1, wherein at least the image carrier and the charging device are combined with a process cartridge.

9. The charging device according to claim 1, wherein at least the image carrier and the charging device, which are combinable with a process cartridge, are installed in an image forming apparatus.

10. The charging device according to claim 1, wherein:

the charge roller cleaner is disposed at a side of the charge roller having an outer circumference which moves away from the image carrier when the charge roller rotates during an image forming operation.

11. A charging device, comprising:

a charging roller configured to oppose an image carrier driven to rotate and rotate to charge the image carrier;

a drive transmission device configured to transmit torque from the image carrier to the charging roller, comprising a gear train configured to generate the torque to drive the charging roller; and a charging roller cleaner configured to contact the charging roller to clean the charging roller, the charging roller cleaner disposed facing a rear surface of the charging roller to receive the torque generated by the gear train in a position to prevent displacement of the charging roller due to a force generated by the torque.

12. The charging device according to claim 11, wherein charging roller cleaner is provided in a range of force components of the torque generated by the gear train.

13. The charging device according to claim 12, wherein the charging roller cleaner is provided in a position satisfying a relation of $\alpha<\beta<\alpha+180$ degrees, wherein $\alpha$ represents the pressure angle and $\beta$ represents an angle formed between a line connecting a center of the image carrier with a center of the charging roller and a contact position between the charging roller cleaner and the charging roller in a direction of rotation of the charging roller.

14. The charging device according to claim 11, wherein the charging roller cleaner is movable in a direction of the torque generated by the gear train and pressed in a direction opposite to the direction of the torque generated by the gear train.

15. The charging device according to claim 11, wherein the charging roller cleaner is roller-shaped.

16. The charging device according to claim 11, wherein the charging roller cleaner is block-shaped and irrotatable.

17. The charging device according to claim 11, wherein at least the image carrier and the charging device are combined with a process cartridge.

18. The charging device according to claim 11, wherein at least the image carrier and the charging device, which are combinable with a process cartridge, are installed in an image forming apparatus.

* * * * *